US011871856B1

(12) United States Patent
Luberto

(10) Patent No.: US 11,871,856 B1
(45) Date of Patent: Jan. 16, 2024

(54) PULLOUT SUPPORT ASSEMBLY FOR MERCHANDISE DISPLAY AND DISPENSING MODULES

(71) Applicant: Henschel-Steinau, Inc., Allendale, NJ (US)

(72) Inventor: Michael D. Luberto, River Vale, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 0 days.

(21) Appl. No.: 17/946,736

(22) Filed: Sep. 16, 2022

(51) Int. Cl.

| | |
|---|---|
| ***A47F 1/12*** | (2006.01) |
| ***A47F 3/02*** | (2006.01) |
| ***A47B 96/02*** | (2006.01) |
| ***A47F 5/00*** | (2006.01) |
| ***A47F 3/06*** | (2006.01) |

(52) U.S. Cl.
CPC ..... *A47F 1/125* (2013.01); *A47B 96/025* (2013.01); *A47F 3/02* (2013.01); *A47F 3/06* (2013.01); *A47F 5/0093* (2013.01)

(58) Field of Classification Search
CPC ..... A47F 1/125; A47F 5/0093; A47F 5/005; A47F 3/004; A47F 3/06; A47F 3/063; A47F 3/02; A47F 5/0043; A47F 5/0081; A47F 5/16; A47F 5/12; A47B 96/025; A47B 45/00; A47B 96/067; A47B 2210/0005; A47B 2210/0056; A47B 88/40; A47B 57/58; A47B 57/00
USPC ..... 211/59.3, 126.15, 184; 312/334.27, 312/334.31, 334.32; 108/60, 61; 248/241, 244
See application file for complete search history.

(56) References Cited

U.S. PATENT DOCUMENTS

| | | | | | |
|---|---|---|---|---|---|
| 3,221,677 | A * | 12/1965 | Kerr | A47B 45/00 | 108/143 |
| 3,658,398 | A * | 4/1972 | Abbate, Jr. | A47B 88/57 | 312/334.44 |
| 4,519,508 | A * | 5/1985 | Gullett | A47F 1/12 | 211/175 |
| 4,653,818 | A * | 3/1987 | DeBruyn | A47B 77/16 | 312/246 |
| 4,662,523 | A * | 5/1987 | Stein | A47F 5/12 | 211/153 |
| 4,762,236 | A * | 8/1988 | Jackle, III | A47F 1/126 | 211/59.3 |
| 4,892,368 | A * | 1/1990 | Goto | A47B 88/57 | 384/21 |
| 4,934,645 | A * | 6/1990 | Breslow | A47B 96/07 | 248/242 |

(Continued)

*Primary Examiner* — Jennifer E. Novosad
(74) *Attorney, Agent, or Firm* — Richard M. Goldberg

(57) ABSTRACT

A pullout support assembly for merchandise display and dispensing modules positioned on a shelf, the pullout support assembly including a guide having two parallel guide walls adapted to attach to an underside of the shelf, the guide walls having two sets of aligned openings; two elongated guide members slidably positioned the aligned guide openings between a first position substantially entirely beneath the shelf and a second position pulled out with respect to the shelf, in which the guide members are adapted to support at least one merchandise display and dispensing module thereon; and a support connected to a front end of the guide members for moving the guide members between the first and second positions.

14 Claims, 27 Drawing Sheets

(56) References Cited

U.S. PATENT DOCUMENTS 5,012,936 A * 5/1991 Crum ..... A47F 1/126 206/556
5,085,154 A * 2/1992 Merl ..... A47F 5/0043 211/184
5,390,802 A * 2/1995 Pappagallo ..... A47F 1/125 211/59.3
5,415,472 A * 5/1995 Brise ..... A47B 96/025 211/153
5,439,122 A * 8/1995 Ramsay ..... A47F 5/0081 211/187
5,673,801 A * 10/1997 Markson ..... A47F 1/126 211/59.3
5,738,019 A * 4/1998 Parker ..... A47B 57/16 211/175
6,021,908 A * 2/2000 Mathews ..... A47F 3/0486 211/175
6,189,707 B1 * 2/2001 Meyers ..... A47B 57/045 248/248
6,332,547 B1 * 12/2001 Shaw ..... A47F 1/12 211/59.2
6,505,749 B1 * 1/2003 Panetta ..... A47F 5/0892 211/163
6,843,382 B2 * 1/2005 Kanouchi ..... A47F 3/063 211/126.15
7,918,353 B1 * 4/2011 Luberto ..... A47F 1/126 312/61
8,087,522 B2 * 1/2012 Stafford ..... A47F 5/10 211/119.003
8,596,443 B2 * 12/2013 Brugmann ..... A47F 5/0093 211/172
9,245,464 B2 * 1/2016 Theisen ..... G09F 3/202
9,408,478 B2 * 8/2016 Vogler ..... A47F 5/0093
9,445,675 B1 * 9/2016 DeSena ..... A47F 1/126
9,486,090 B2 * 11/2016 Juric ..... A47F 5/0093
9,565,952 B1 * 2/2017 Luberto ..... A47F 1/126
9,782,017 B1 * 10/2017 Luberto ..... A47F 1/125
10,123,637 B1 * 11/2018 DeSena ..... A47F 5/0068
10,130,196 B2 * 11/2018 Burns ..... A47F 1/12
10,334,967 B2 * 7/2019 Mercier ..... A47F 5/0093
10,398,239 B1 * 9/2019 Luberto ..... A47F 5/0025
11,064,817 B2 * 7/2021 Turner ..... A47F 5/0093
11,160,394 B1 * 11/2021 Luberto ..... A47F 5/0043
11,375,826 B2 * 7/2022 Hardy ..... A47B 73/006
2009/0223916 A1 * 9/2009 Kahl ..... A47F 1/12 211/85.4
2011/0100941 A1 * 5/2011 Luberto ..... A47F 1/126 211/134
2011/0147323 A1 * 6/2011 Sainato ..... A47F 1/12 40/642.02
2012/0292277 A1 * 11/2012 Chikkakalbalu ..... A47B 96/027 248/250
2013/0068708 A1 * 3/2013 Johnson ..... A47F 1/04 211/59.3
2015/0243193 A1 * 8/2015 Trinh ..... A47F 5/0043 211/150
2018/0279782 A1 * 10/2018 Liss ..... A47B 57/16
2020/0132360 A1 * 4/2020 Kumar ..... F25D 25/024

* cited by examiner

PULLOUT SUPPORT ASSEMBLY FOR MERCHANDISE DISPLAY AND DISPENSING MODULES

BACKGROUND OF THE INVENTION

The present invention relates generally to a pullout support assembly for merchandise display and dispensing modules that permits restocking the merchandise display and dispensing modules without completely removing them from the shelf on which they are positioned for sale.

Stores conventionally display items to be sold on shelves throughout the store.

Conventionally, in order to restock a merchandise display and dispensing module that is positioned on shelf, with merchandise, it has been necessary to completely remove the merchandise display and dispensing module from the shelf and place the merchandise display and dispensing module on a separate cart. Once the merchandise display and dispensing module has been restocked, the merchandise display and dispensing module is then repositioned back on the shelf. This, however, is burdensome, and more importantly, time consuming.

In addition, from a safety standpoint, it is also possible with present day arrangements for a consumer to remove the merchandise display and dispensing module from the shelf, which is undesirable.

SUMMARY OF THE INVENTION

Accordingly, it is an object of the present invention to provide a pullout support assembly for merchandise display and dispensing modules that overcomes the aforementioned problems.

It is another object of the present invention to provide a pullout support assembly for merchandise display and dispensing modules which supports each merchandise display and dispensing module in a pulled out position from the shelf, in order to restock the merchandise display and dispensing module, without completely removing the merchandise display and dispensing module from the shelf.

It is still another object of the present invention to provide a pullout support assembly for merchandise display and dispensing modules that prevents removal of each merchandise display and dispensing module from the shelf by a consumer.

It is yet another object of the present invention to provide a pullout support assembly for merchandise display and dispensing modules that locks each merchandise display and dispensing module on the shelf to prevent tampering or inadvertent removal of the merchandise display and dispensing module.

It is a further object of the present invention to provide a pullout support assembly for merchandise display and dispensing modules that requires only minor modification to an existing shelf.

It is a still further object of the present invention to provide a pullout support assembly for merchandise display and dispensing modules that easy and economical to use and manufacture.

In accordance with an aspect of the present invention, a pullout support assembly is provided for merchandise display and dispensing modules positioned on a shelf. The pullout support assembly includes a guide adapted to attach to an underside of the shelf, the guide having at least one guide opening. At least one elongated guide member is slidably positioned in the at least one guide opening of the guide between a first position substantially entirely beneath the shelf and a second position pulled out with respect to the shelf, in which the at least one elongated guide member is adapted to support at least one merchandise display and dispensing module thereon. A support is connected to a front end of the at least one elongated guide member for moving the at least one elongated guide member between the first and second positions.

The guide includes two walls extending down from the underside of the shelf, and the at least one guide opening includes aligned openings in the two walls for slidably receiving the at least one elongated guide member therein.

Preferably, the at least one elongated guide member includes two parallel, spaced apart guide members, and the two walls have two sets of the aligned openings for slidably receiving the two parallel, spaced apart guide members therein.

There is also at least one fixed guide member fixedly secured to the guide within the at least one guide opening, and the at least one elongated guide member is telescopically slidable within the at least one fixed guide member.

A resilient locking bar is secured to the support, and extends through a further opening in the guide in the first position to releasably lock the at least one elongated guide member and the support in the first position. The locking bar includes a locking projection for lockingly engaging with the guide in the first position to prevent pulling out of the at least one elongated guide member with respect to the shelf.

Preferably, the locking bar includes a resilient member with the locking projection positioned on the resilient member, such that the resilient member is adapted to be biased to a position that releases the locking projection from the locking engagement with the guide in the first position to permit pulling out of the at least one elongated guide member with respect to the shelf.

The locking projection has a triangular cross-sectional configuration.

Each merchandise display and dispensing module includes a combination finger grip and stop at a front end thereof which is adapted to be grasped to raise the front end of the respective merchandise display and dispensing module to remove the merchandise display and dispensing module from the shelf, and the support includes an upper wall that covers a portion of the combination finger grip and stop in the first position to prevent raising up of the front end of the respective merchandise display and dispensing module in the first position. Specifically, the combination finger grip and stop includes forwardly extending tabs and the upper wall covers the tabs in the first position to prevent raising up of the front end of the respective merchandise display and dispensing module.

The at least one elongated guide member further includes a limiting arrangement to limit the extent that the at least one elongated guide member is adapted to be pulled out with respect to the shelf.

A shelf locking plate is secured to the shelf at a position below a front portion of the merchandise display and dispensing modules, for engaging with the merchandise display and dispensing modules to restrain movement of the merchandise display and dispensing modules on the shelf.

Each merchandise display and dispensing module includes a combination finger grip and stop at a front end thereof which is adapted to be grasped to raise the front end of the respective merchandise display and dispensing module to remove the merchandise display and dispensing module from the shelf, and the shelf includes a raised front edge and the shelf locking plate includes a bent forward edge spaced slightly by a gap from the raised front edge, with the combination finger grip and stop received in the gap to restrain movement of the merchandise display and dispensing modules on the shelf.

In addition, the shelf locking plate includes a rearward extending bend and each merchandise display and dispensing module includes a lower finger for engaging with the rearward extending bend to restrain movement of the merchandise display and dispensing modules on the shelf.

Lastly, the support includes a lower wall that covers a portion of guide in the first position.

The above and other features of the invention will become readily apparent from the following detailed description thereof which is to be read in connection with the accompanying drawings.

DETAILED DESCRIPTION

Figure 1:
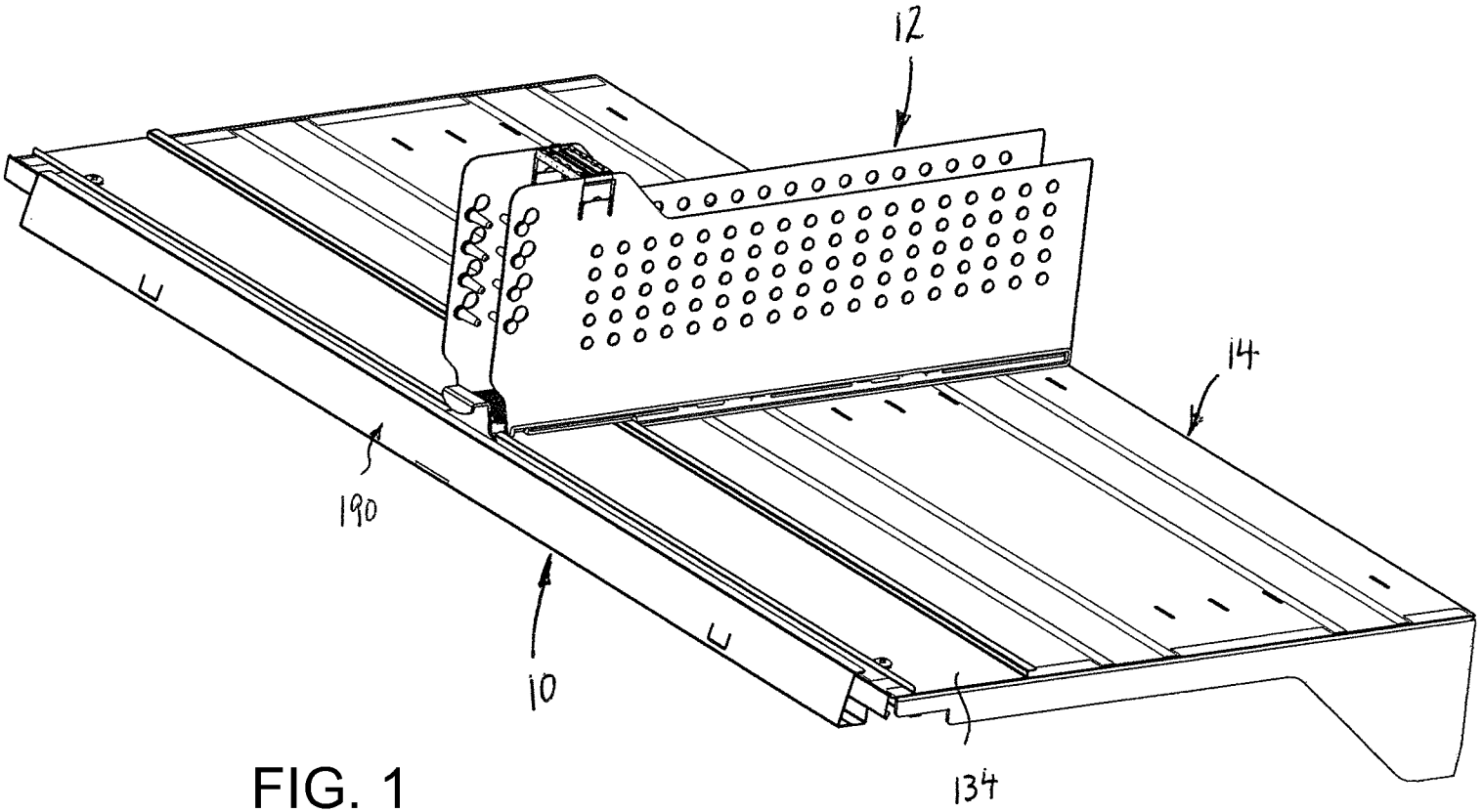
FIG. 1 is a front, top perspective view of a pullout support assembly for merchandise display and dispensing modules in accordance with the present invention, shown in connection with a single merchandise display and dispensing module on a shelf.
Figure 2:
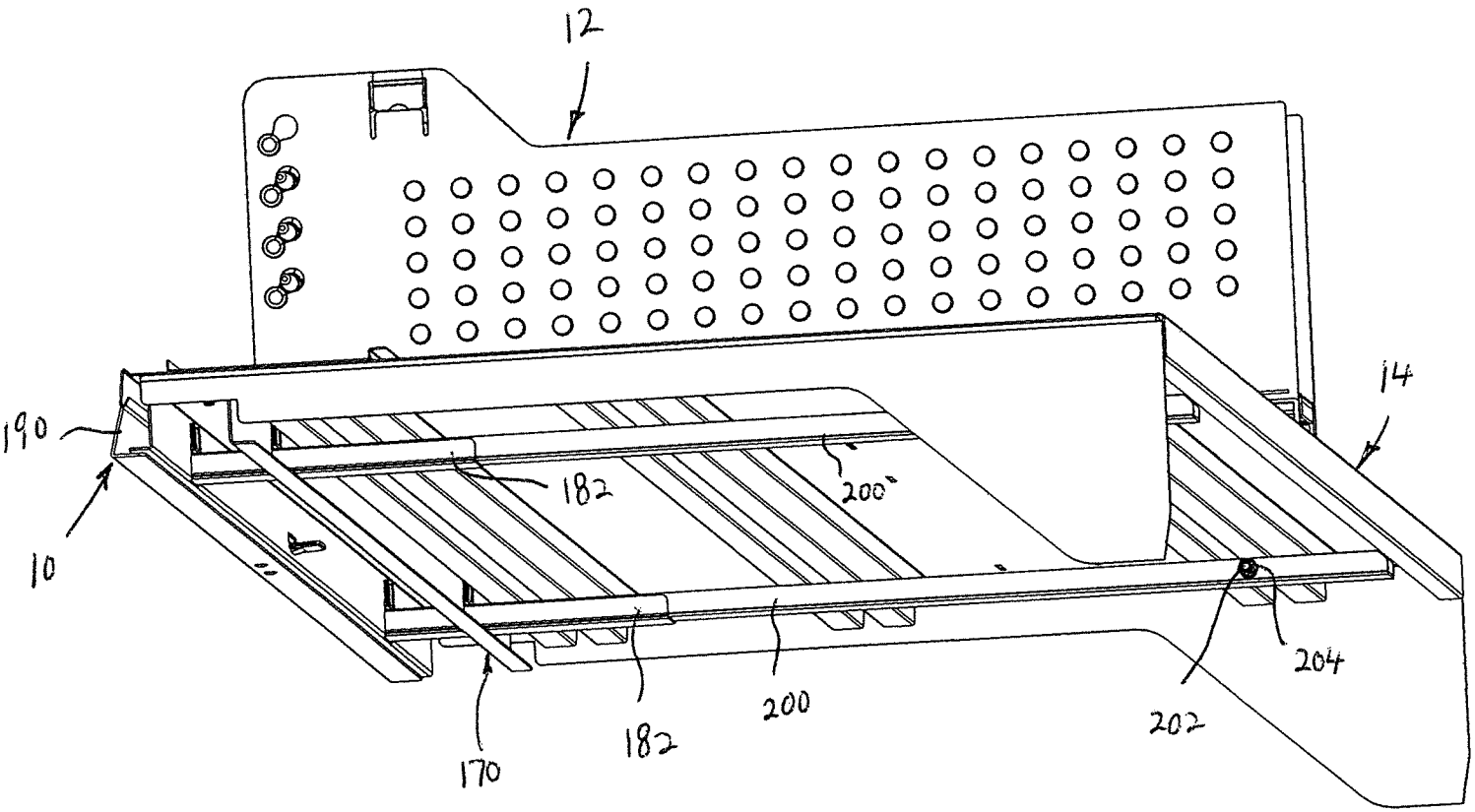
FIG. 2 is a bottom perspective view of the pullout support assembly of FIG. 1.
Figure 3:
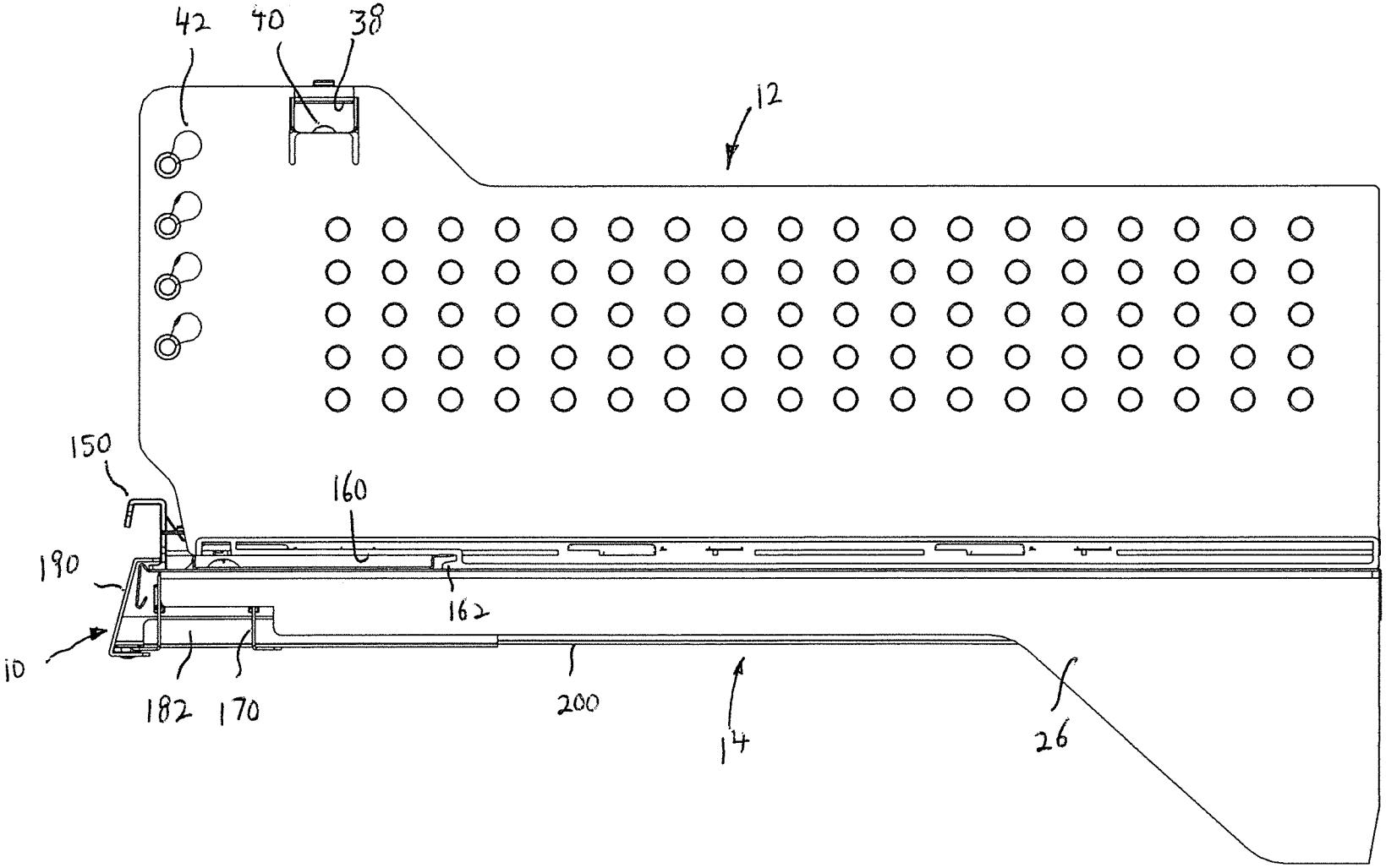
FIG. 3 is a side elevational view of the pullout support assembly of FIG. 1.
Figure 4:
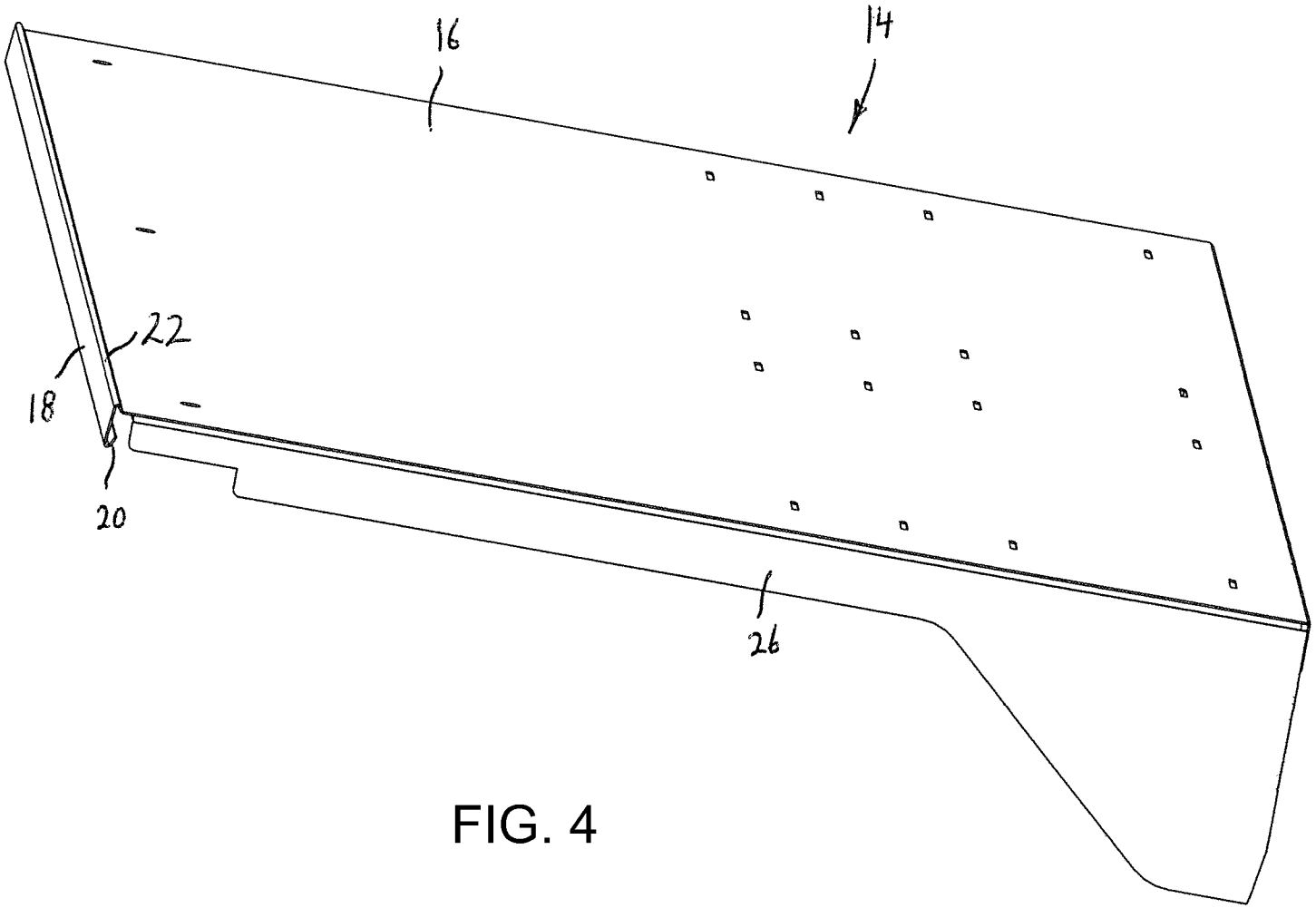
FIG. 4 is a top perspective view of the shelf of FIG. 1.
Figure 5:
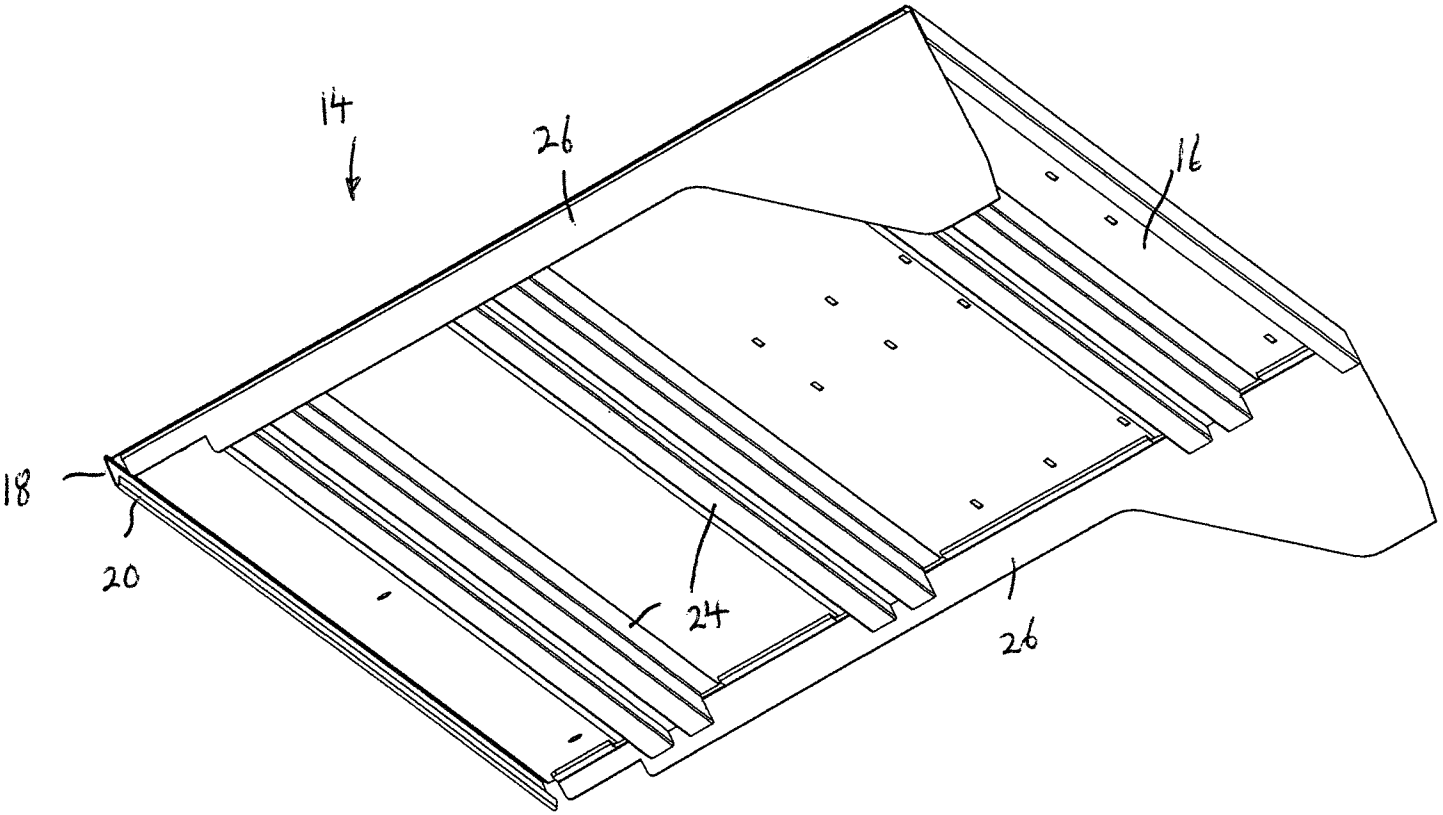
FIG. 5 is a bottom perspective view of the shelf.
Figure 6:
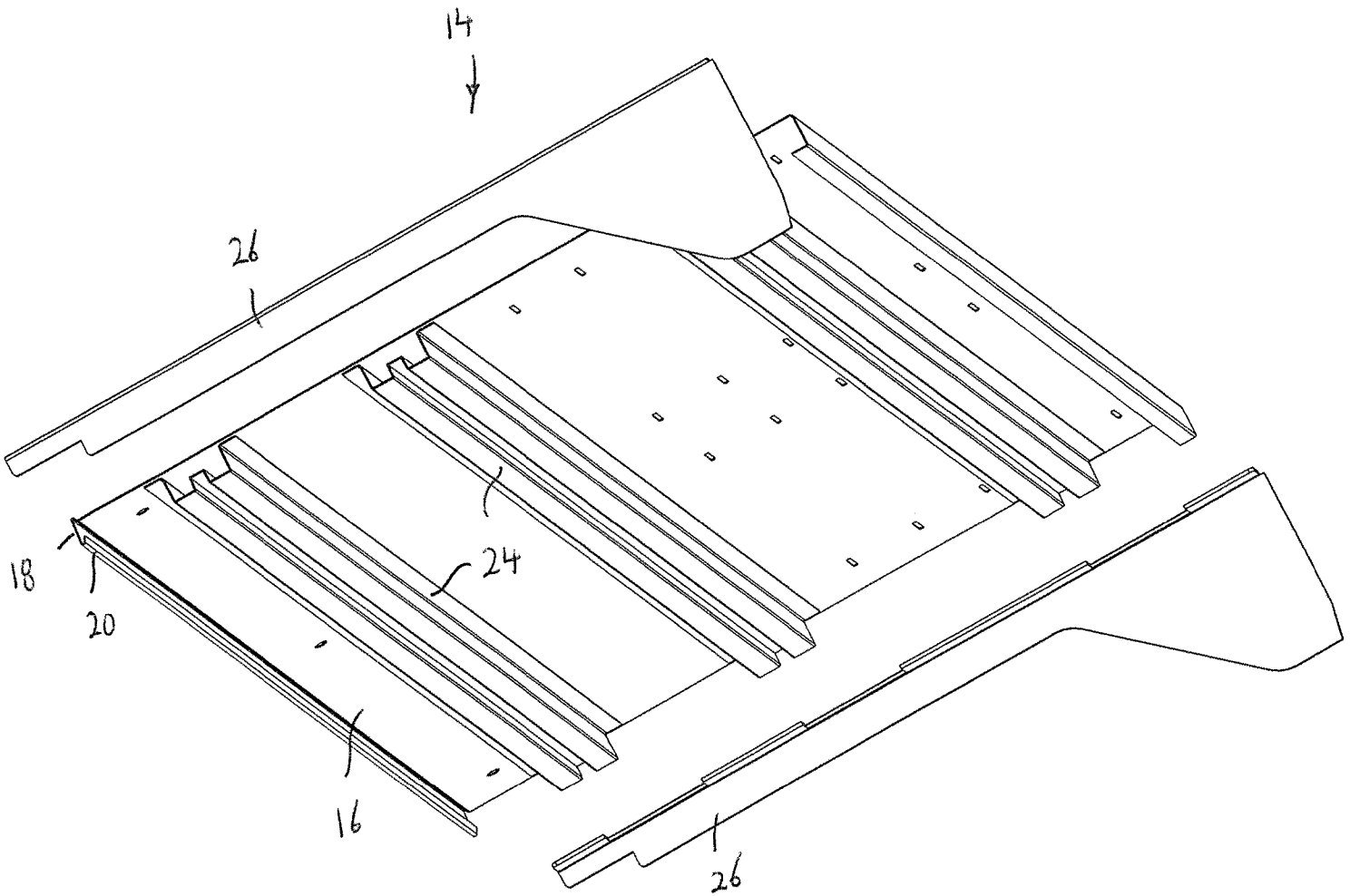
FIG. 6 is an exploded, bottom perspective view of the shelf.
Figure 7:
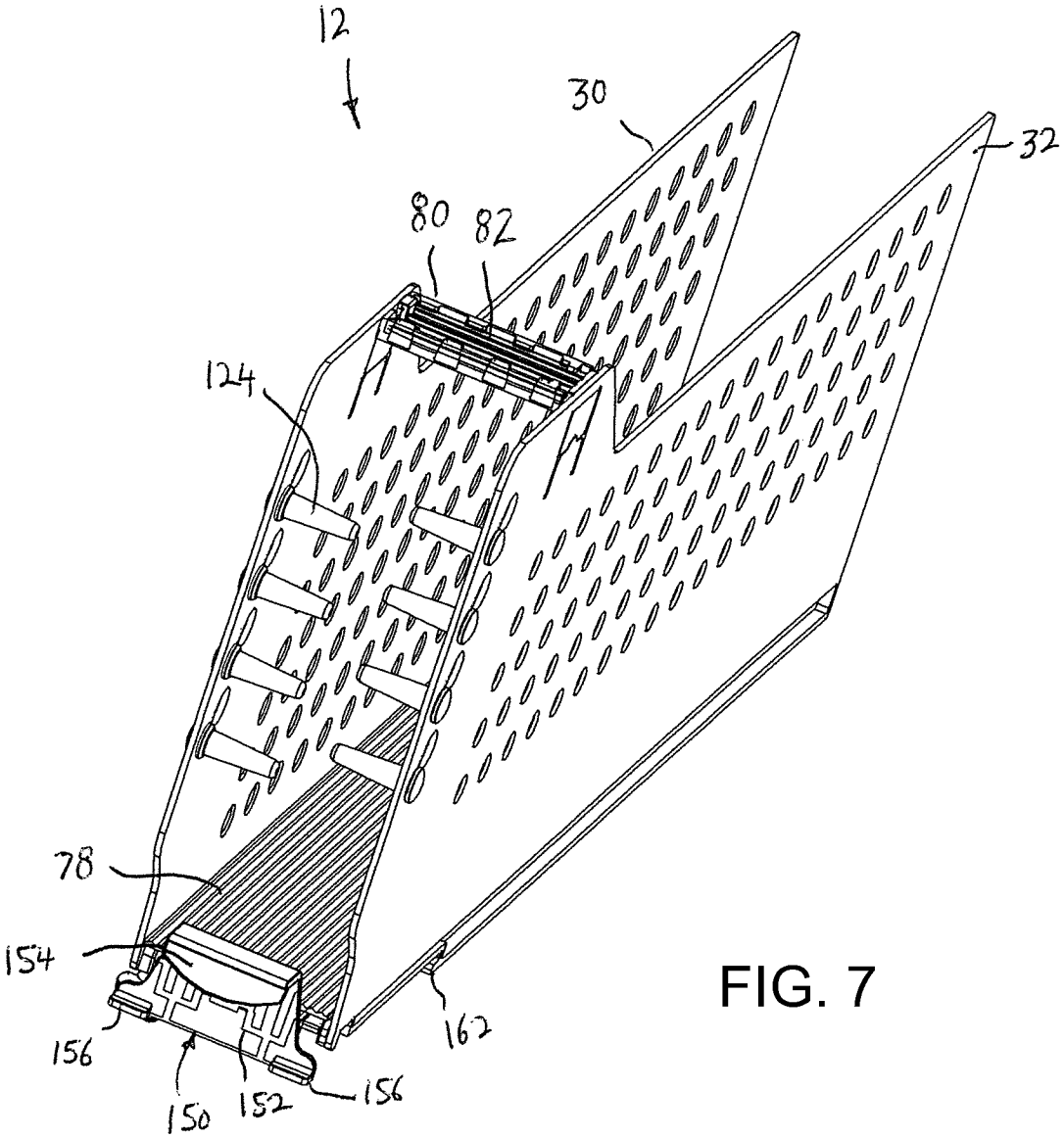
FIG. 7 is a front, top perspective view of the merchandise display and dispensing module of FIG. 1.
Figure 8:
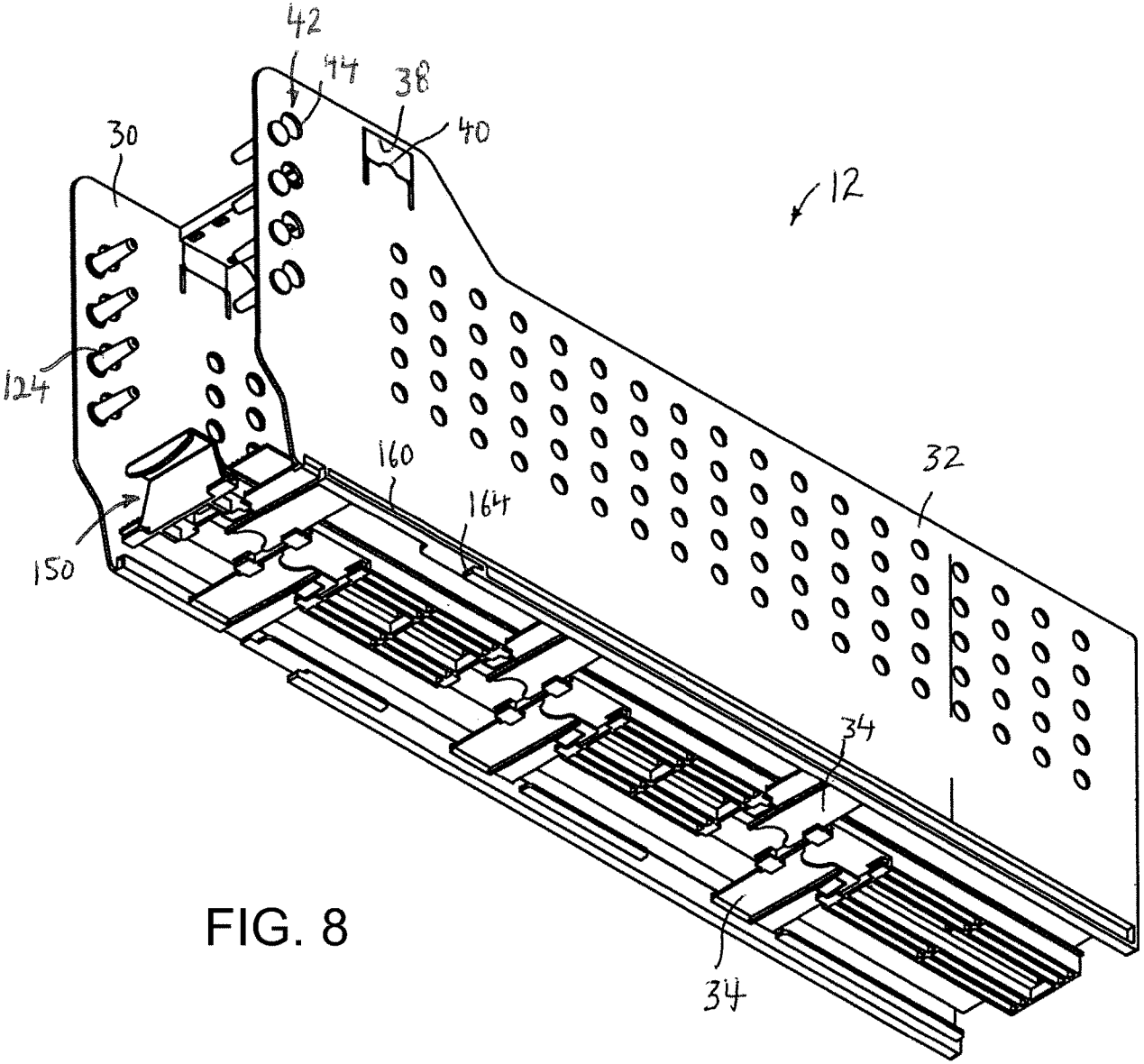
FIG. 8 is a front, bottom perspective view of the merchandise display and dispensing module.
Figure 9:
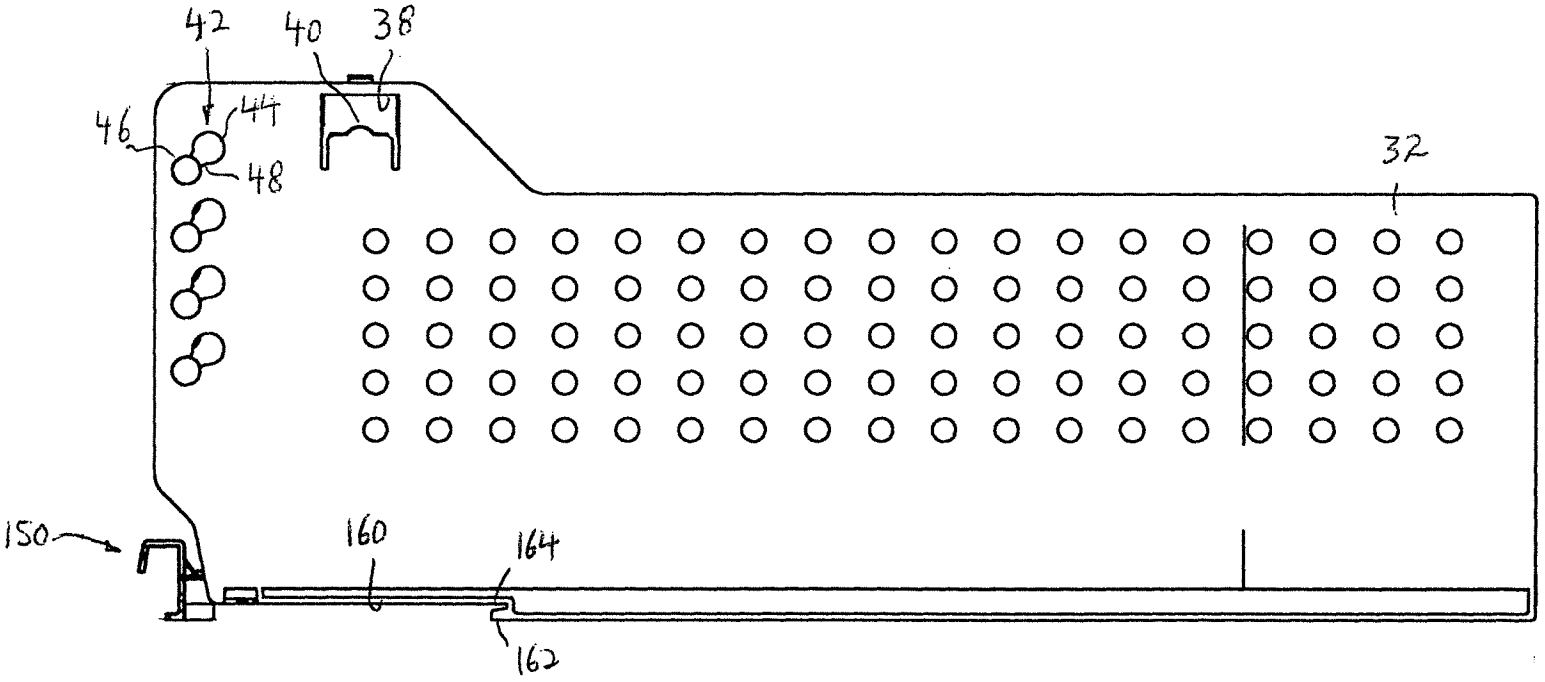
FIG. 9 is a side elevational view of the merchandise display and dispensing module.

Referring to the drawings, and initially to FIGS. 1-3, a pullout support assembly 10 according to the present invention is disclosed for merchandise display and dispensing modules 12 positioned on a shelf 14 in a store.

Stores conventionally display items to be sold on shelves throughout the store. For example, as shown in FIGS. 1-6, a shelf 14 that can be used with the present invention includes a rectangular planar support 16 having a downwardly turned front edge plate section 18 with an inwardly and upturned lower end 20. At the connection of downwardly turned front plate section 18 with rectangular planar support 16, there is a slight upward bend to define a module stop 22, as will be understood from the discussion hereafter. Step wave shaped plates 24 are connected to the underside of rectangular planar support 16 to increase the structural rigidity of rectangular planar support 16. In addition, two opposite side walls 26 extend downwardly from opposite side edges of rectangular planar support 16.

Shelf 14 is adapted to support a plurality of merchandise display and dispensing modules 12 thereon in adjacent, abutting relation. Only one such merchandise display and dispensing module 12 is shown for the sake of simplicity.

Specifically, as shown in FIGS. 7-13, merchandise display and dispensing module 12 includes first and second parallel, spaced apart side walls 30 and 32 extending along a lengthwise direction. Each side wall 30 and 32 has spaced apart lower connection tabs 34 extending inwardly from a lower edge thereof, transverse to the lengthwise direction, that is, extending in a transverse direction toward the opposite side wall. Lower connection tabs 34 of side wall are offset from lower connection tabs 34 of side wall 32 so that they do not overlap. As shown best in FIG. 13, each tab 34 includes a row of triangular teeth 36 on the upper surface thereof, with the row extending in the transverse direction. While three such tabs 34 are shown for each side wall 30 and 32, the present invention is not limited thereby.

Each side wall 30 and 32 further includes a generally rectangular opening 38 positioned slightly below the upper edge and space slightly inwardly from the front edge of the respective side wall. The wall defining the lower edge of the generally rectangular opening 38 further includes a semicircular projection 40, the purpose for which will become apparent hereafter.

Lastly, side walls 30 and 32 each have a plurality of vertically spaced apart openings 42 adjacent the front edge thereof and positioned forwardly of generally rectangular opening 38. Although four such openings 42 are shown for each side wall 30 and 32, the present invention is not limited thereby, and any number of openings can be provided. Each opening 42 includes an upper opening 44 of a first diameter and a lower opening 46 of a smaller diameter in communication with the upper opening 44 through a narrow constriction 48. Preferably, the lowermost opening 42 is positioned sufficiently high to enable a lowermost item of stacked merchandise to be removed from the front end of merchandise display and dispensing module 12 at a position below the lowermost opening 42.

Figure 11:
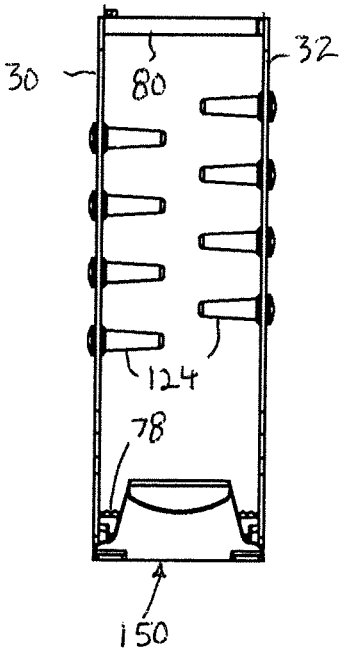
FIG. 11 is a front elevational view of the merchandise display and dispensing module in a narrow configuration.
Figure 12:
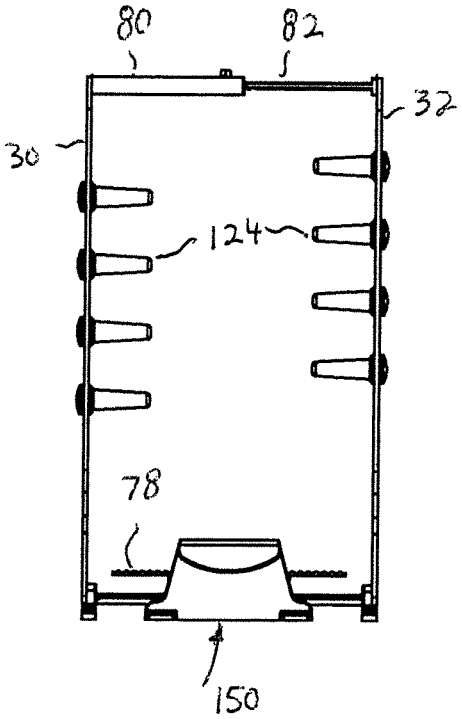
FIG. 12 is a front elevational view of the merchandise display and dispensing module in a wide configuration.
Figure 13:
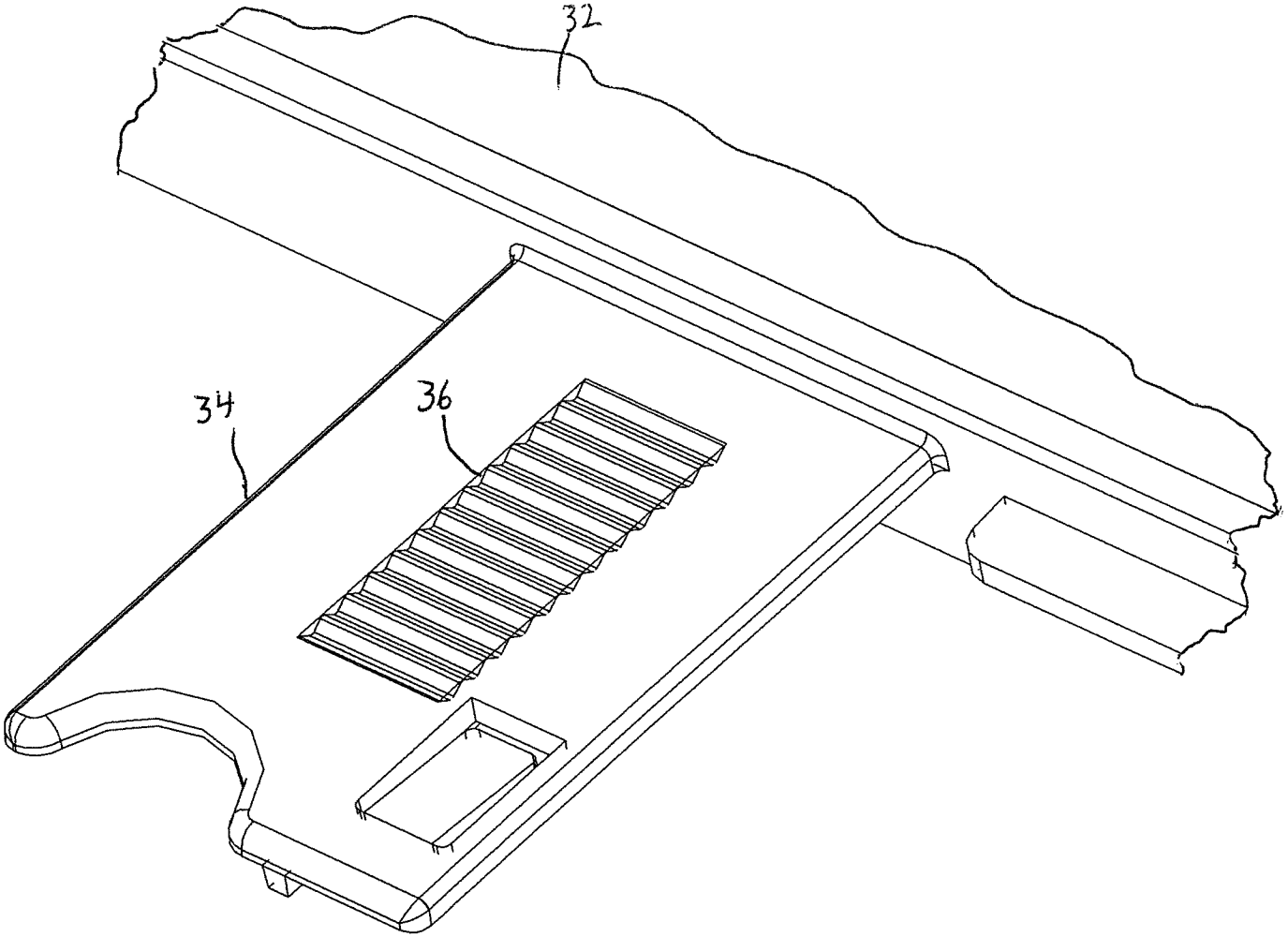
FIG. 13 is a perspective view of a lower connection tab of one side wall of the merchandise display and dispensing module.
Figure 14:
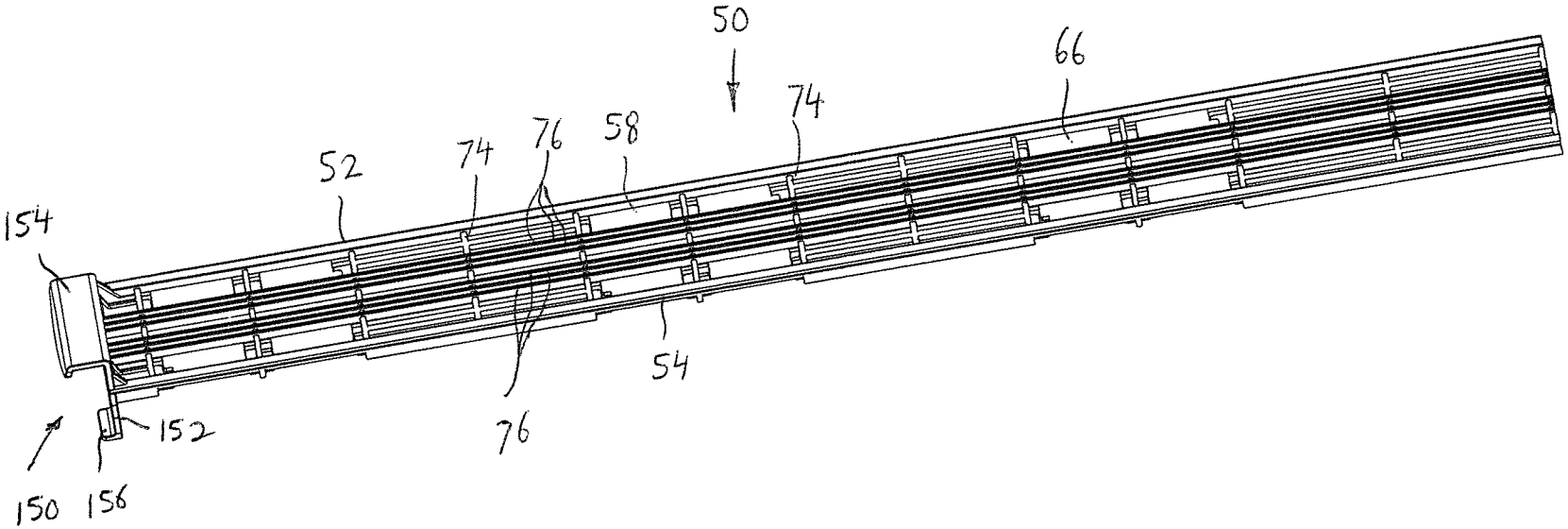
FIG. 14 is a top perspective view of the elongated connection platform of the merchandise display and dispensing module.
Figure 15:
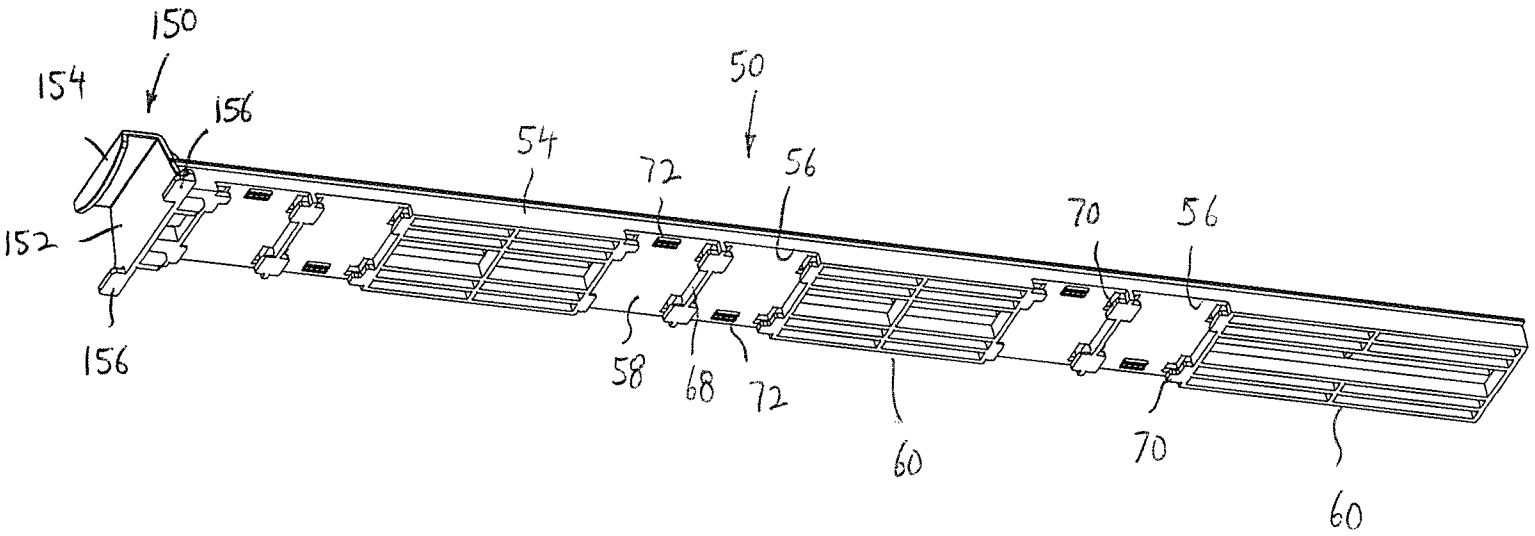
FIG. 15 is a bottom perspective view of the elongated connection platform of the merchandise display and dispensing module.
Figure 16:
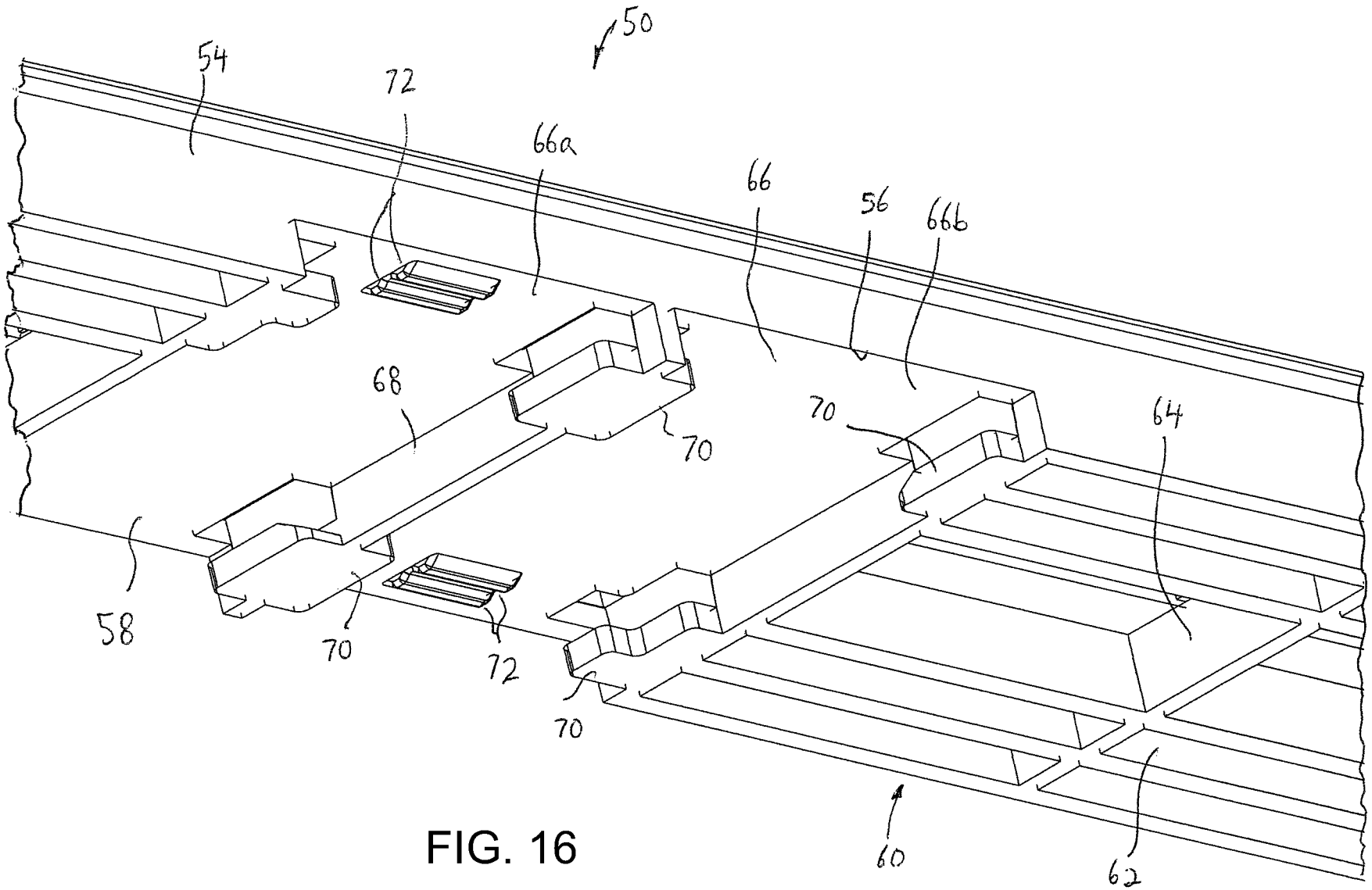
FIG. 16 is an enlarged bottom perspective view of a portion of the elongated connection platform of the merchandise display and dispensing module.

As shown best in FIGS. 10 and 14-16, an elongated connection platform 50 is positioned between sidewalls 30 and 32, with connection tabs 34 extending into elongated connection platform 34 for connection therewith, to connect together side walls 30 and 32 in a parallel, spaced apart relation. The extent that lower connection tabs 34 are inserted within connection platform 50 will determine the separation between the sidewalls 30 and 32. In this manner, the space between sidewalls 30 and 32 can be adjusted for different size merchandise, as shown in FIGS. 11 and 12.

In this regard, elongated connection platform 50 is formed by two lengthwise side walls 52 and 54, each having three rectangular, spaced apart, cut-out portions 56 at the lower edge thereof. Three spaced apart bottom walls 58 connect together side walls 52 and 54 at the positions of cut-out portions 56, with the lower surfaces of bottom walls 58 being coplanar with the lower edges of side walls 52 and 54 thereat, and with the upper surfaces of bottom walls 58 being positioned below the upper edges of side walls 52 and 54.

A matrix 60 of lengthwise extending walls 62 and transverse extending walls 64 connects together side walls 52 and 54 at positions between and adjacent to bottom walls 58, with the lower edges of lengthwise extending walls 62 and transverse extending walls 64 being coplanar with the lower edges of side walls 52 and 54 thereat. As a result, each matrix 60 extends to a position below the lower surface of bottom walls 52 and 54, thus creating an open space 66 below bottom walls 58, bounded by the respective matrices 60. A dividing wall 68 extends down from each bottom wall 58 in a transverse direction, thereby dividing open space 66 in half to provide a first half open space **66*a* and a second half open space 66*b*, bounded by a respective matrix 60 and dividing wall 68. Further, tabs 70 extend into each half open space 66*a* and 66*b* from the lower edge of the respective matrix 60 and dividing wall 68**.

The lower surface of each bottom wall 58 in half open space **66*a* is provided with two rounded teeth 72 adjacent side wall 54, while the lower surface of each bottom wall 58 in half open space 66*b* is provided with two rounded teeth 72 adjacent side wall 52**.

A plurality of spaced apart transverse rails 74 are connected between side walls 52 and 54 at positions above bottom walls 58 and matrices 60, and a plurality of spaced apart lengthwise rails 76 are connected between end ones of transverse rails 74, at positions above bottom walls 58 and matrices 60. The upper edges of transverse rails 74 and lengthwise rails 76 are coplanar to form an upper surface of elongated connection platform 50, while also functioning to increase the structural integrity of elongated connection platform 50.

With this arrangement, lower connection tabs 34 of side walls 30 and 32 extend within respective half open spaces **66*a* and 66*b*, held therein by tabs 70. In such position, the row of triangular teeth 36 of each lower connection tab 34 engages with the respective two rounded teeth 72, so as to slide thereover in a meshing relation, with pressure applied by tabs 70 to retain the teeth in the meshing arrangement, while allowing adjustment thereof. In this manner, the width of merchandise display and dispensing module 12 can be adjusted, as shown in FIGS. 11 and 12**.

A mat 78 is fixed on top of elongated connection platform 50 in order to better support merchandise thereon.

In order to releasably lock merchandise display and dispensing module 12 in the selected widthwise dimension, a first ratchet bar 80 is fixed to one side wall 30 and a second ratchet bar 82 is fixed to the other side wall 32 for engagement with first ratchet bar 80.

Figure 10:
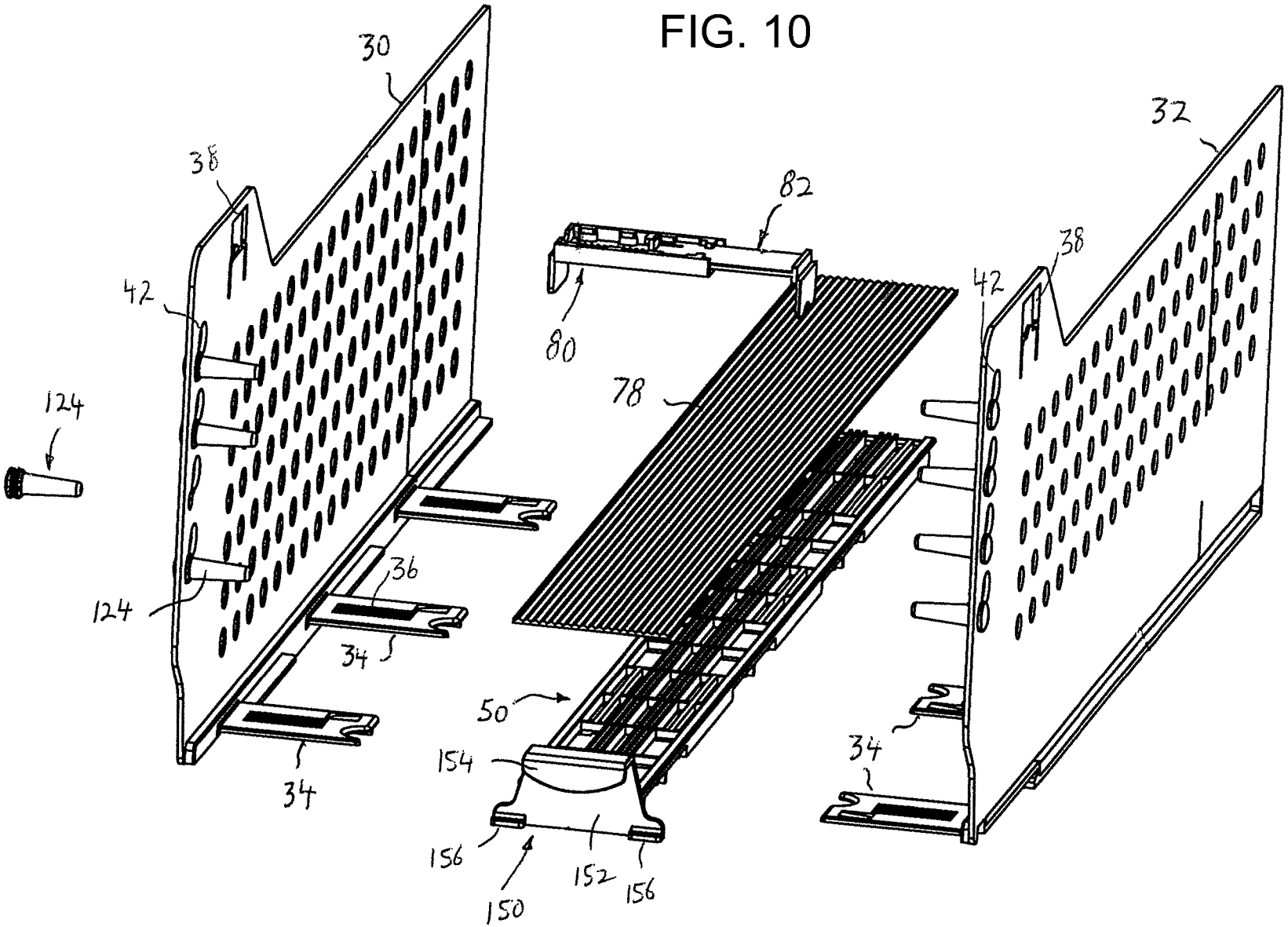
FIG. 10 is an exploded perspective view of the merchandise display and dispensing module.
Figure 17:
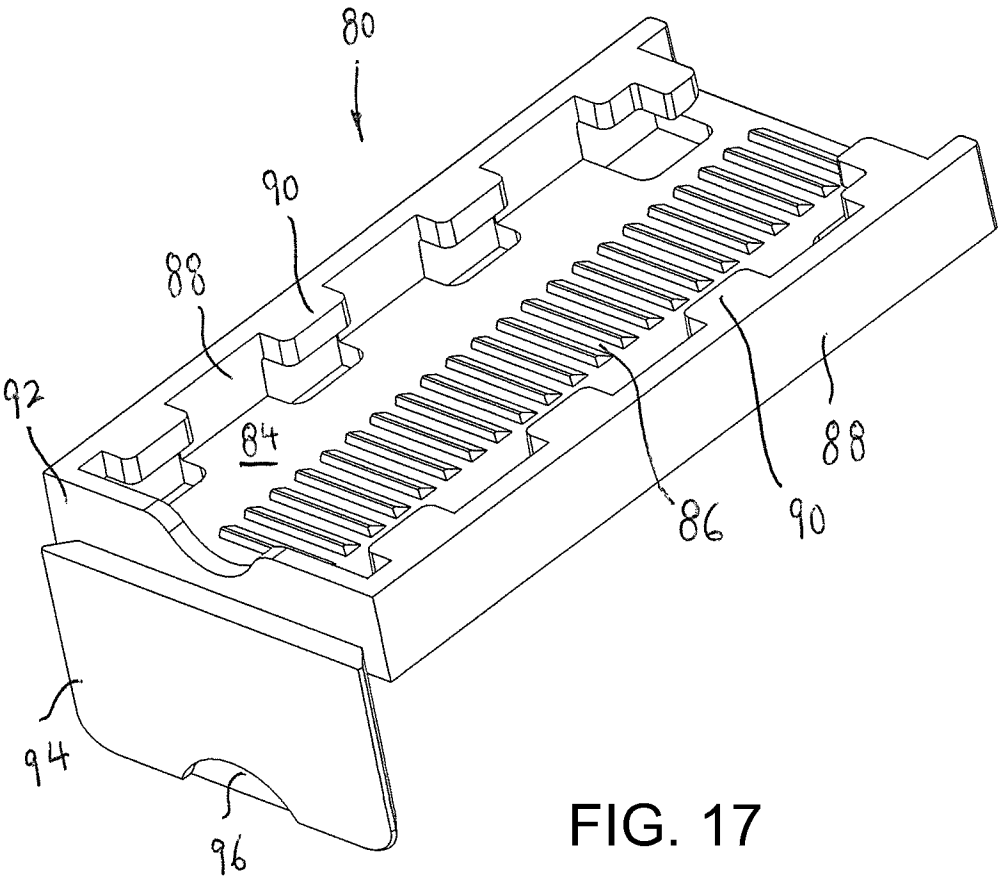
FIG. 17 is a top perspective view of the first ratchet bar of the merchandise display and dispensing module.

Specifically, as shown best in FIGS. 10 and 17, first ratchet bar 80 includes an elongated rectangular, planar bottom plate 84 having a plurality of ratchet teeth 86 extending spaced apart relation in the lengthwise direction thereof. Two opposite side walls 88 extend upwardly from side edges of bottom plate 84, with spaced apart hold-down tabs 90 extending inwardly from the upper edges of side walls 88 in spaced relation from the upper surface of bottom plate 84. Side walls 88 are connected together by an end wall 92 at one end which is also connected to bottom plate 84, with the opposite ends of sidewalls 88 being open. A fixing plate 94 is connected to the outer surface of end wall 92 and extends downwardly past the lower and thereof. The upper edge of fixing plate 94 is spaced below the upper edge of end wall 92. Further, the lower edge of fixing plate 94 has a semicircular recess 96 in the outer surface thereof.

With this arrangement, fixing plate 94 is fixedly connected within generally rectangular opening 38 of side wall 30, with semicircular recess 96 receiving semicircular projection 40. In this position, the portion of end wall 92 that extends above fixing plate 94 is positioned flush against the inner surface of sidewall 30. With this arrangement, first ratchet bar 80 extends toward the opposite side wall 32.

Figure 18:
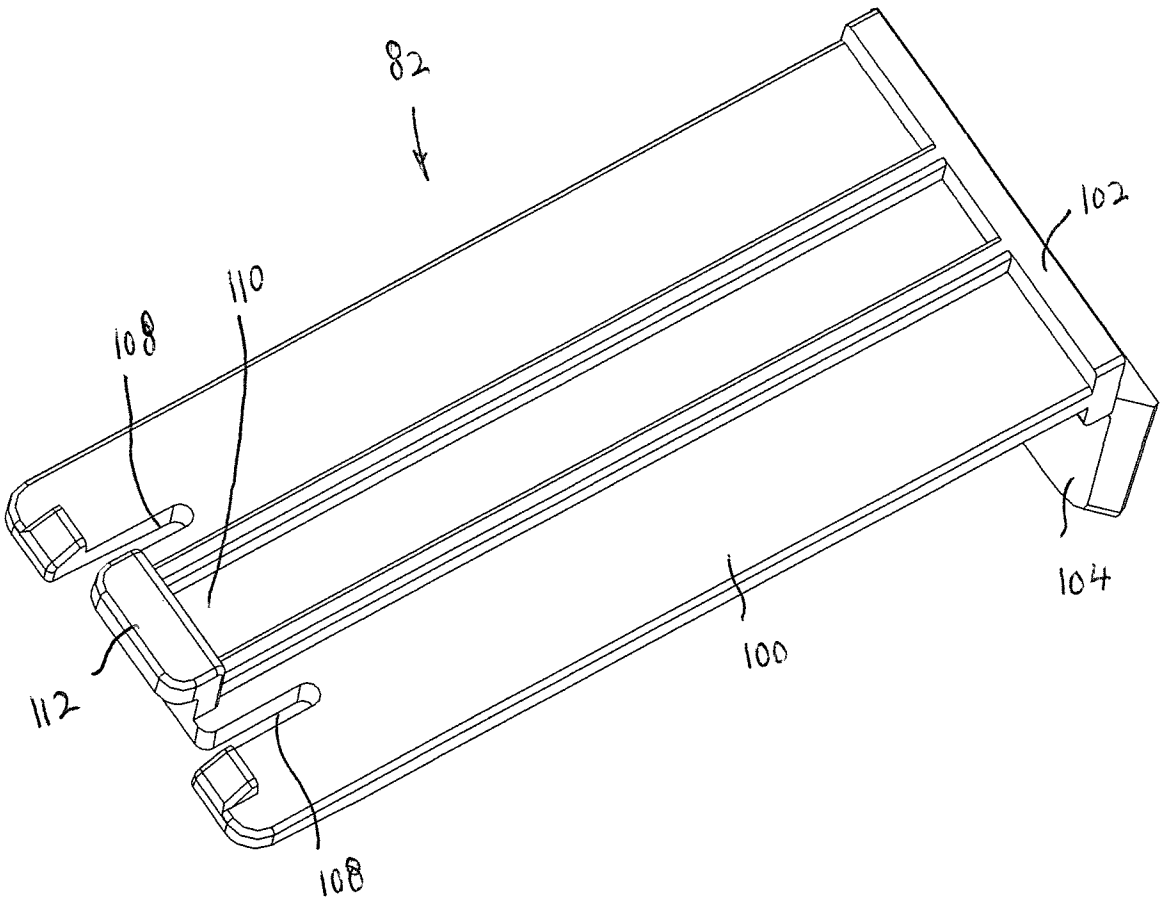
FIG. 18 is a top perspective view of the second ratchet bar of the merchandise display and dispensing module.
Figure 19:
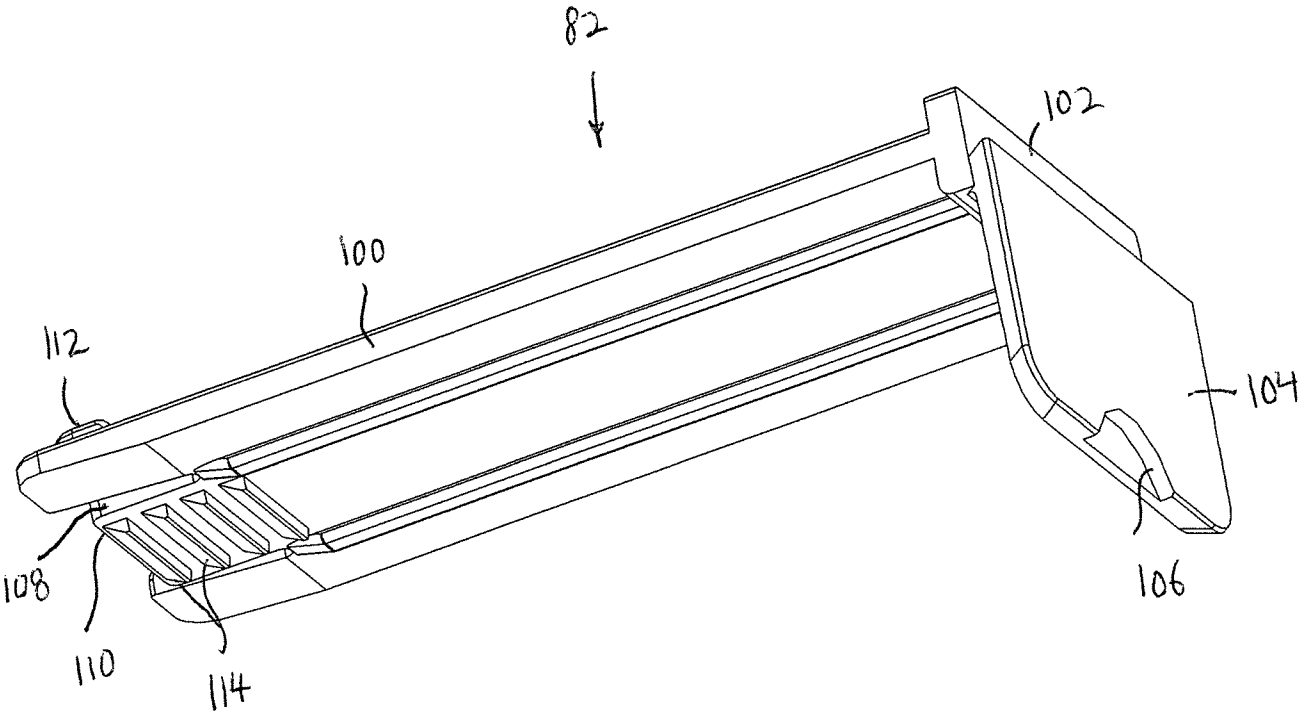
FIG. 19 is a bottom perspective view of the second ratchet bar.

As shown best in FIGS. 10, 18 and 19, second ratchet bar 82 includes an elongated rectangular, planar plate 100. An end wall 102 is connected to one end of planar plate. A fixing plate 104 is connected to the outer surface of end wall 102 and extends downwardly past the lower and thereof. The upper edge of fixing plate 104 is spaced below the upper edge of end wall 102. Further, the lower edge of fixing plate 104 has a semicircular recess 106 in the outer surface thereof.

With this arrangement, fixing plate 104 is fixedly connected within generally rectangular opening 38 of side wall 32, with semicircular recess 106 receiving semicircular projection 40. In this position, the portion of end wall 102 that extends above fixing plate 94 is positioned flush against the inner surface of sidewall 32. With this arrangement, second ratchet bar 82 extends toward the opposite side wall 30.

The opposite free end of planar plate 100 includes two spaced apart, lengthwise extending slits 108, defining a resilient tab 110 therebetween. A finger hold 112 extends upwardly from the free edge of resilient tab 110 in order to slightly bend resilient tab 110 upwardly. A plurality, for example, four, ratchet teeth 114 are formed on the lower surface of resilient tab 110.

In this regard, when lower connection tabs 34 are inserted within elongated connection platform 50, planar plate 100 of second ratchet bar 82 is slid over planar bottom plate 84 of first ratchet bar 80, and held down thereon by hold-down tabs 90. As planar plate 100 is slid over planar bottom plate 84, ratchet 114 teeth engage with ratchet teeth 86 to lock first and second ratchet bars 80 and 82 together. In order to release ratchet teeth 86 and 114, finger hold 112 is pulled upwardly, thereby disengaging ratchet teeth 114 from ratchet teeth 86, whereby sidewalls 30 and 32 can be pulled apart and the width of merchandise display and dispensing module 12 can be adjusted.

Figure 20:
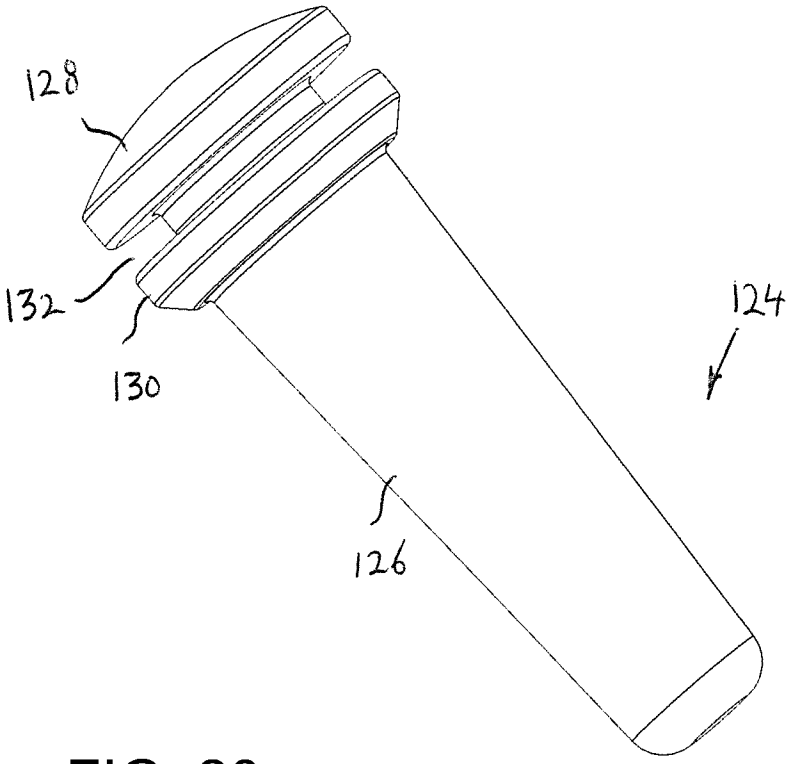
FIG. 20 is a perspective view of a stop finger of the merchandise display and dispensing module.

As shown best in FIGS. 10 and 20, plurality of stop fingers 124 are provided for insertion within selected ones of the openings 42. Although not limited thereto, each stop finger 124 preferably includes a truncated cone 126 of a resilient material. A circular head 128 is formed at the larger diameter end of truncated cone 126 and an annular ring 130 is provided around truncated cone in slightly spaced relation to circular head 128, thereby provided a small annular gap 132 therebetween. In this manner, truncated cone 126 is initially inserted through a respective upper opening 44 and then pushed down so that narrow constriction 48 passes through annular gap 132, whereby annular gap 132 is positioned in the small diameter lower opening 46, and whereby circular head 128 and annular ring 130 retain stop finger 124 therein. In this manner, truncated cone 126 extends inwardly from the respective side wall 30 or 32 to retain any merchandise therein.

It will be appreciated that the merchandise within merchandise display and dispensing module 50 can be biased toward the front end thereof by means of gravity if shelf 14 is angled downwardly. Alternatively, a spring biasing arrangement (not shown) which is well known in the art, can be provided with merchandise display and dispensing module for biasing the merchandise toward the front and thereof.

Figure 21:
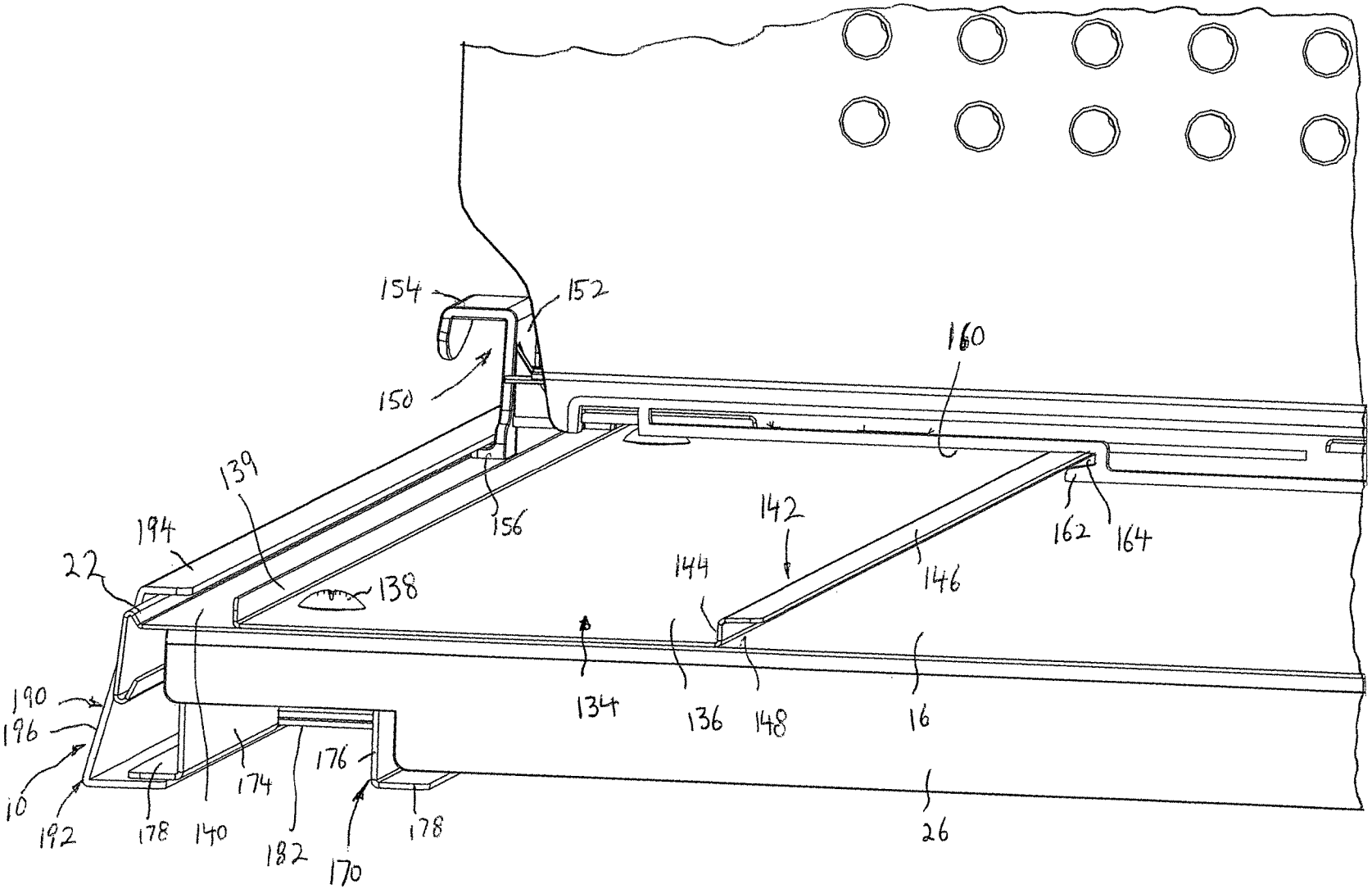
FIG. 21 is an enlarged top perspective view of a front portion of the pullout support assembly for merchandise display and dispensing modules in accordance with the present invention, shown in connection with the single merchandise display and dispensing module on a shelf.
Figure 22:
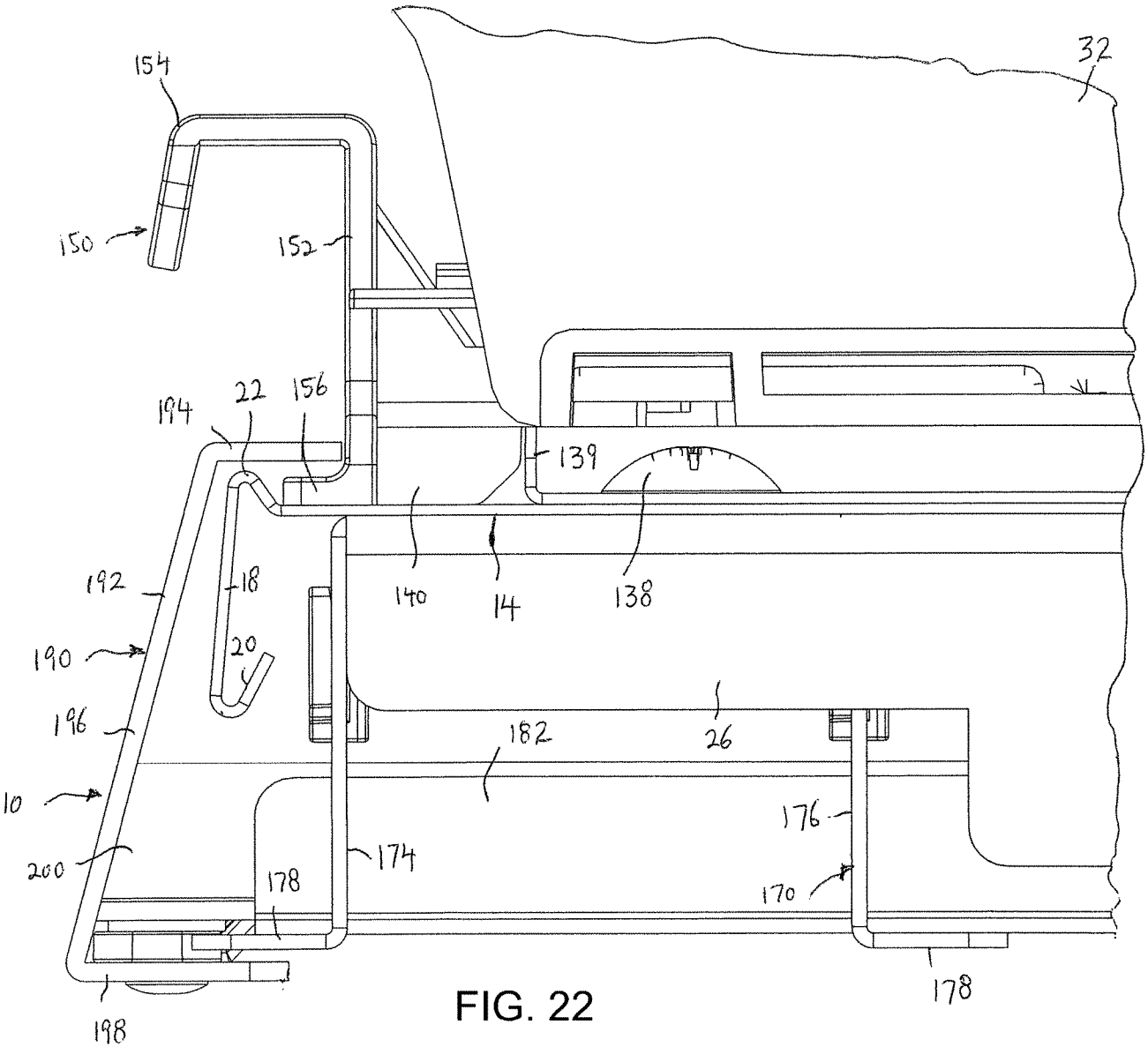
FIG. 22 is a side elevational view of the arrangement of FIG. 21.
Figure 23:
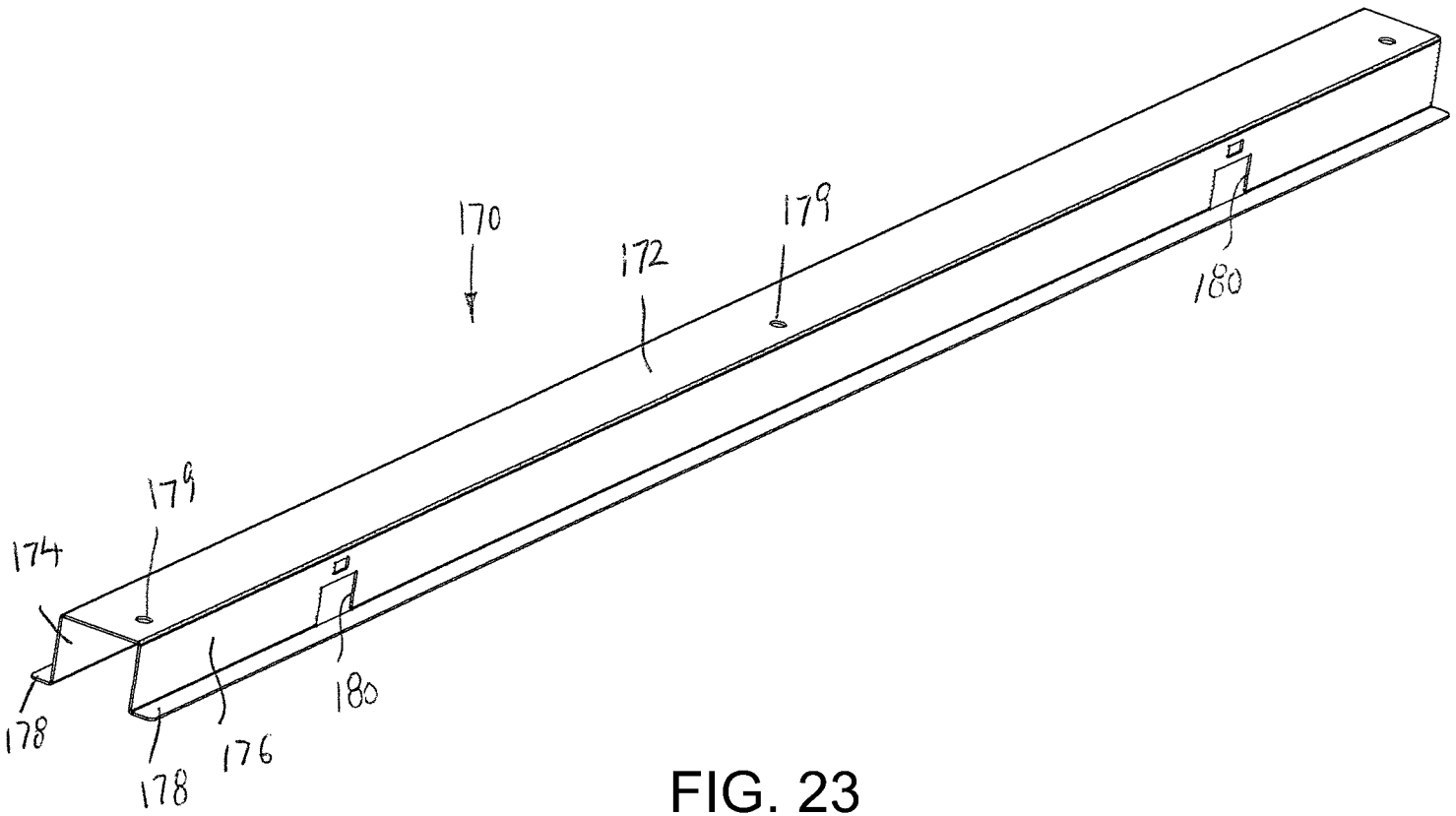
FIG. 23 is a top perspective view of the elongated guide of the pullout support assembly.
Figure 24:
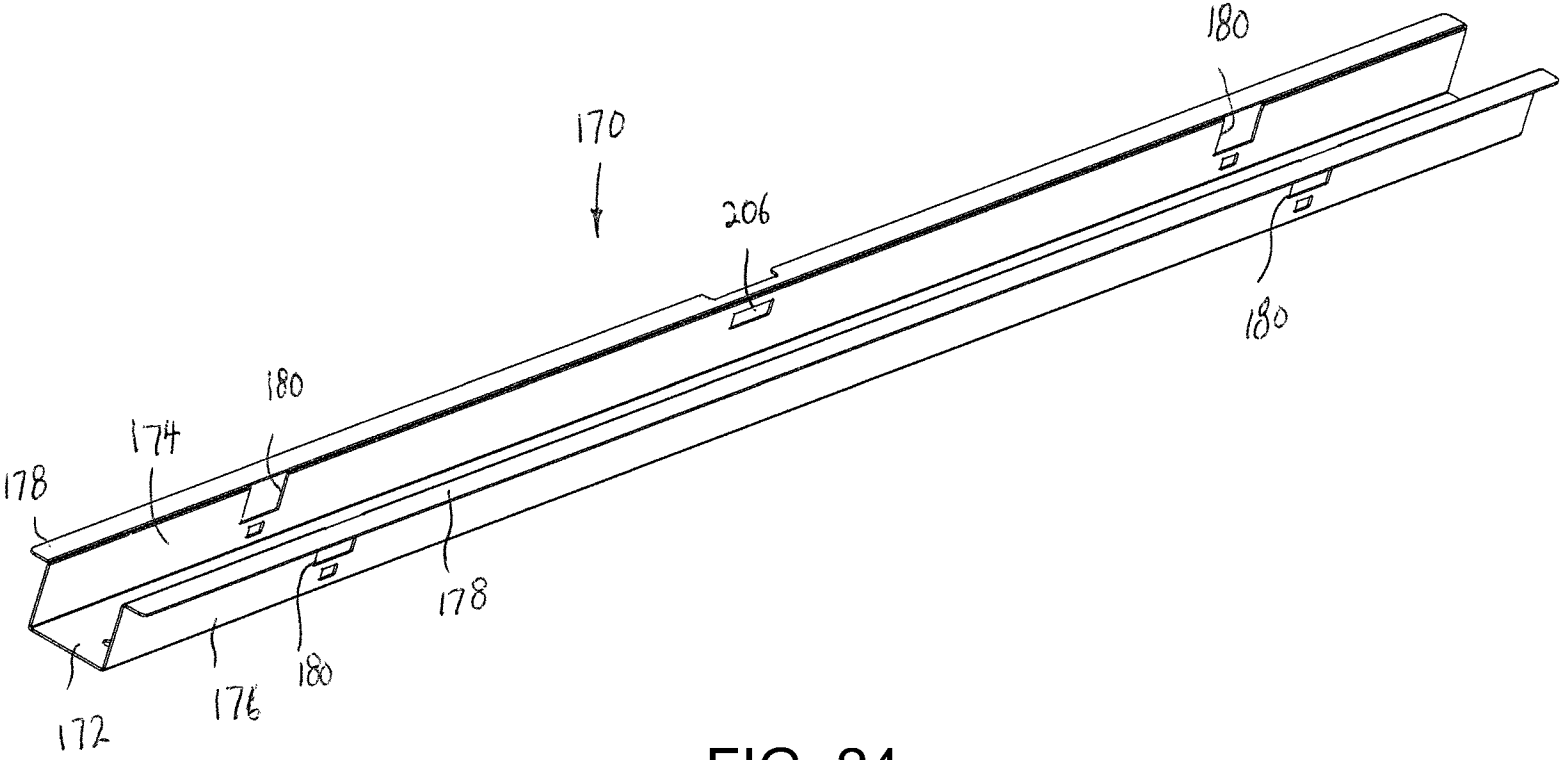
FIG. 24 is a bottom perspective view of the elongated guide of the pullout support assembly.
Figure 25:
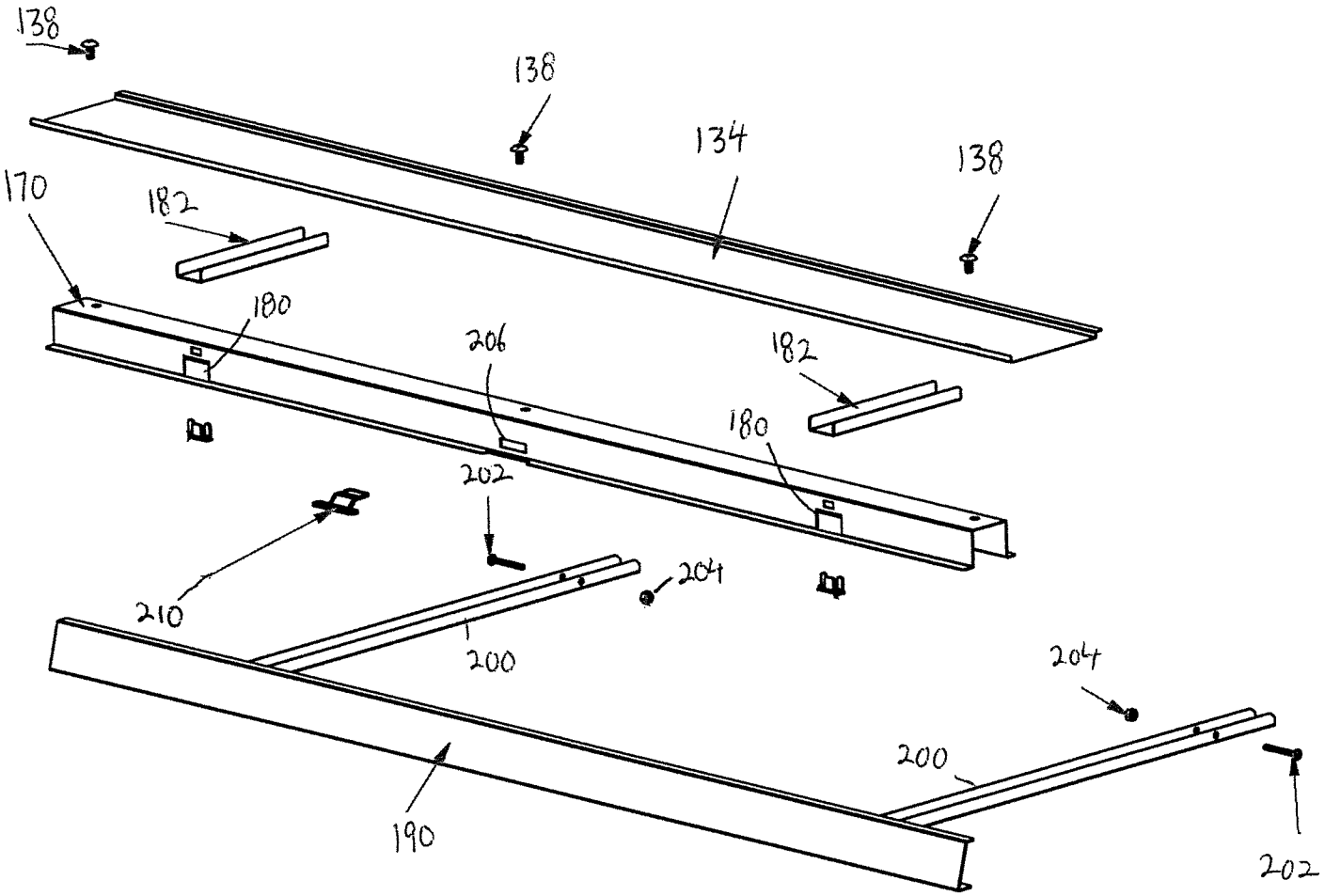
FIG. 25 is an exploded perspective view of the pullout support assembly.

In order to position and retain merchandise display and dispensing module 12 on shelf 14, a shelf locking plate 134 is secured to shelf 14 at the forward end thereof and extending in the side-to-side direction of shelf 14. Shelf locking plate 134 includes an elongated, rectangular plate 136 having a plurality of openings therein through which threaded fasteners 138 can extend for securing shelf locking plate 134 to shelf 14. The forward elongated end of rectangular plate 136 is bent upwardly at 90° from rectangular plate 136 to form an upward bend 139 and is spaced slightly rearwardly of module stop 22 to provide a gap 140 therebetween, as best shown in FIGS. 20 and 21. The rear elongated end of rectangular plate 136 has an L-shaped bend 142 (FIG. 21) with an upward bent wall 144 and a rearward bent wall 146, with the rearward bent wall 146 being positioned in parallel, spaced relation above shelf 14 to define a gap 148 therebetween.

A combination finger grip and stop 150 is secured to or formed integrally at the front end of elongated connection platform 34. Combination finger grip and stop 150 includes a vertically oriented plate 152 secured to or formed integrally with the front edge of elongated connection platform 34. Preferably, the front edge of elongated connection platform 34 is connected substantially midway of the height of plate 152. The upper end of plate 152 is bent forward and downward to form an L-shaped finger grip 154. Two limit tabs 156 extend forwardly from opposite ends at the lower front edge of plate 152.

In addition, the lower end of each sidewall 30 and 32 has a cut-away portion 160 at the lower edge at the front portion thereof, with a lower finger 162 extending forwardly from the lower end of the uncut portion of each sidewall 30 and 32 so as to be in parallel, spaced apart relation from the lower edge of cut-away portion 160, thereby defining a capture recess 164 therebetween, as best shown in FIG. 21.

When merchandise display and dispensing module 12 is positioned on shelf 14, rearward bent wall 146 is positioned within capture recess 164, and combination finger grip and stop 150 is positioned on shelf 14 within gap 140, with limit tabs 156 abutting against module stop 22 of shelf 14.

Conventionally, as previously discussed, in order to restock merchandise display and dispensing module 12 with merchandise, it has been necessary to completely remove merchandise display and dispensing module 12 from shelf 14 and place merchandise display and dispensing module 12 on a separate cart. Once merchandise display and dispensing module 12 has been restocked, merchandise display and dispensing module 12 is then repositioned back on shelf 14. This, however, is burdensome, and more importantly, time consuming.

In addition, from a safety standpoint, it is also possible with present day arrangements for a consumer to remove merchandise display and dispensing module 12 from shelf 14, which is undesirable.

In accordance with the present invention, a pullout support assembly 10 is provided to support each merchandise display and dispensing module 12 in a pulled out position from shelf 14, in order to restock merchandise display and dispensing module, without completely removing merchandise display and dispensing module 12 from shelf 14. In addition, pullout support assembly 10 locks each merchandise display and dispensing module 12 on shelf 14 after merchandise display and dispensing module 12 has been restocked, to prevent tampering or inadvertent removal of a merchandise display and dispensing module 12.

Pullout support assembly 10 includes an elongated guide 170 secured to the underside of shelf 14, as shown best in FIGS. 2 and 21-24. Elongated guide 170 has a generally U-shaped configuration in cross-section, with an upper elongated wall 172 and two downwardly extending side walls 174 and 176 at opposite ends of upper elongated wall 172. The lower ends of side walls 174 and 176 are bent outwardly the form outwardly extending elongated flange walls 178.

Upper elongated wall 172 includes a plurality of openings 179 for receiving threaded fasteners 138 in order to fixedly secure upper elongated wall 172 to the undersurface of shelf 14.

Each side wall 174 and 176 includes two spaced apart, rectangular openings 180 near opposite ends thereof, with the rectangular openings 180 of side wall 174 being in alignment with rectangular openings 180 of side wall 176. A U-shaped fixed guide 182 (FIG. 2) extends through each set of aligned openings 180 and is welded to elongated guide 170 at the positions of openings 180, so as to be fixedly secured thereto. In this position, the front end of each U-shaped guide 182 extends just slightly forwardly of front side wall 174, but extends further rearwardly from the rear side wall 176, and has a length that occupies about one third the front to rear length of shelf 14.

Pullout support assembly 10 further includes a slidable support 190 having an elongated pullout member 192 with a generally trapezoidal cross-sectional shape. Specifically, elongated pullout member 192 includes an upper transverse elongated plate 194, a forwardly and outwardly inclined plate 196 extending downwardly from the front edge of transverse elongated plate 194 and a lower transverse elongated plate 198 that extends rearwardly from the lower edge of forwardly and outwardly inclined plate 196, so as to be in parallel, spaced relation to upper transverse elongated plate 194.

Two U-shaped telescoping guides 200 are connected to and extend rearwardly from the rear surface of forwardly and outwardly inclined plate 196 in sliding engagement within U-shaped guides 182. Telescoping guides 200 have a length equal generally to the forward to rearward length of shelf 14. Further, a screw 202 extends transversely through each telescoping guide 200 near the rear end thereof, with a nut 204 threadedly secured thereon, as shown in FIG. 2. Each screw 202 and nut 204 combination functions as a stop to prevent telescoping guides 200 from being pulled entirely out from U-shaped guides 182.

With this arrangement, when it is necessary to restock a merchandise display and dispensing module 12, pullout support assembly 10 is pulled away from shelf 14 by pulling elongated pullout member 192 away from shelf 14. When this occurs, telescoping guides 200 telescope outwardly from elongated fixed guides 182 until screw 202 and nut 204 combination abut against the rear end of each respective elongated fixed guide 182. Then, L-shaped finger grip 154 is lifted up slightly and merchandise display and dispensing module 12 is pushed back slightly until rearward bent wall 146 is no longer located within capture recess 164. At this point, merchandise display and dispensing module 12 is raised up slightly higher and pulled forwardly over shelf locking plate 134, and then onto pulled out telescoping guides 200, where it is accessible for restocking. After it is restocked, merchandise display and dispensing module 12 is pushed back, and then move slightly forward until rearward bent wall 146 is again positioned within capture recess 164. Then, combination finger grip and stop is dropped down into gap 140, captured between the forward elongated upward bend 139 of rectangular plate 136 and module stop 22.

Thereafter, pullout support assembly 10 is pushed back so that telescoping guides 200 slide within fixed guides 170 until they are completely positioned below shelf 14. When fully pushed in, upper transverse elongated plate 194 of elongated pullout member 192 rides over module stop 22 of shelf 14 and over limit tabs 156 of combination finger grip and stop 150 to prevent combination finger grip and stop 150 from being lifted up inadvertently or intentionally by a consumer. At the same time, lower transverse elongated plate 198 of elongated pullout member 192 rides under outwardly extending elongated flange wall 178 of front facing side wall 174.

Accordingly, with the present invention, it is unnecessary to completely remove merchandise display and dispensing module 12 and place it on a separate cart for restocking. Rather, since merchandise display and dispensing module 12 is supported by telescoping guides 200 at the position of shelf 14 itself, each merchandise display and dispensing module 12 can be restocked at this position, thereby providing easier restocking of each merchandise display and dispensing module 12.

In order to prevent pullout support assembly 10 from being pulled away from shelf 14 by a consumer, a locking arrangement is also provided. Specifically, front side wall 174 further includes a rectangular opening 206 midway between rectangular openings 180.

Figure 26:
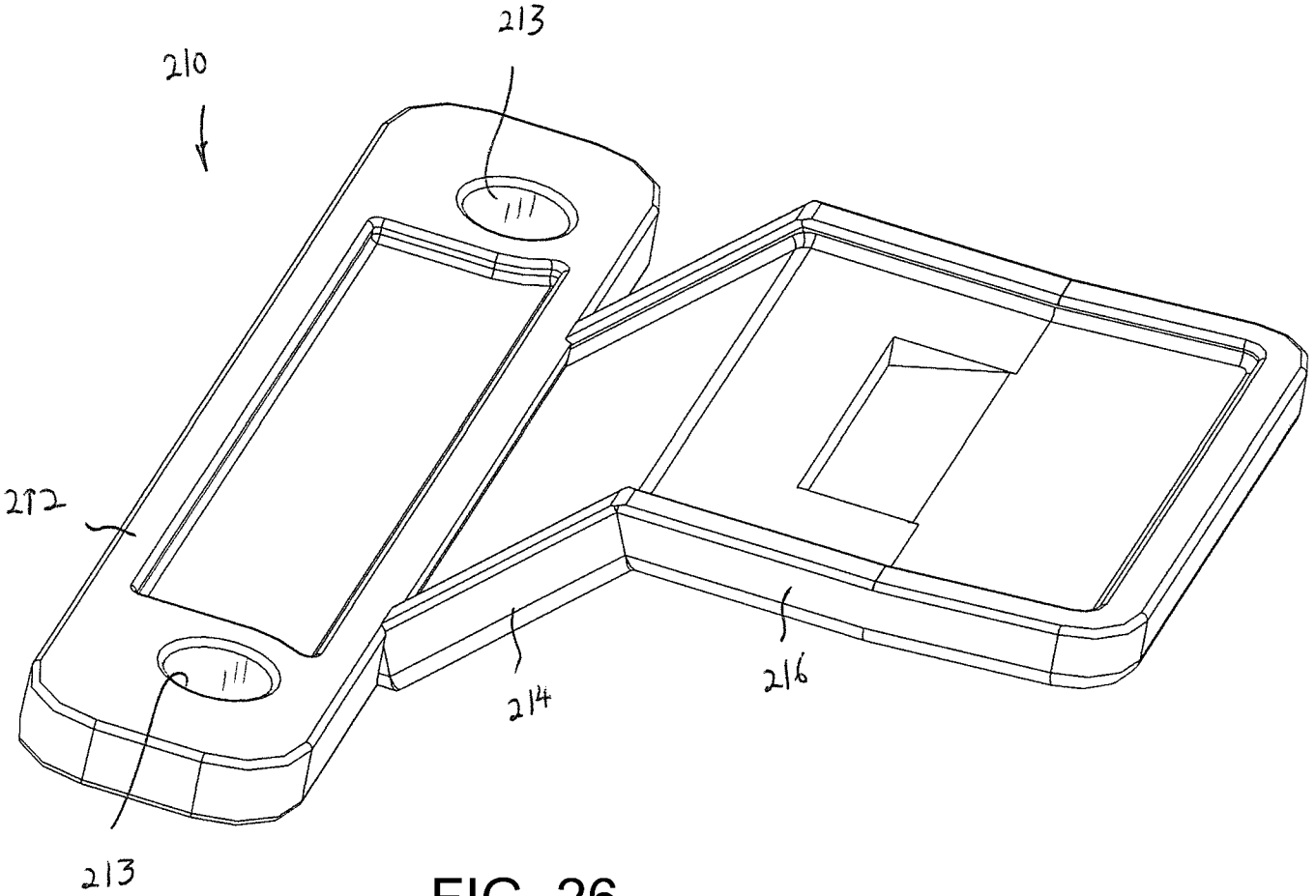
FIG. 26 is a top perspective view of the locking bar of the pullout support assembly.
Figure 27:
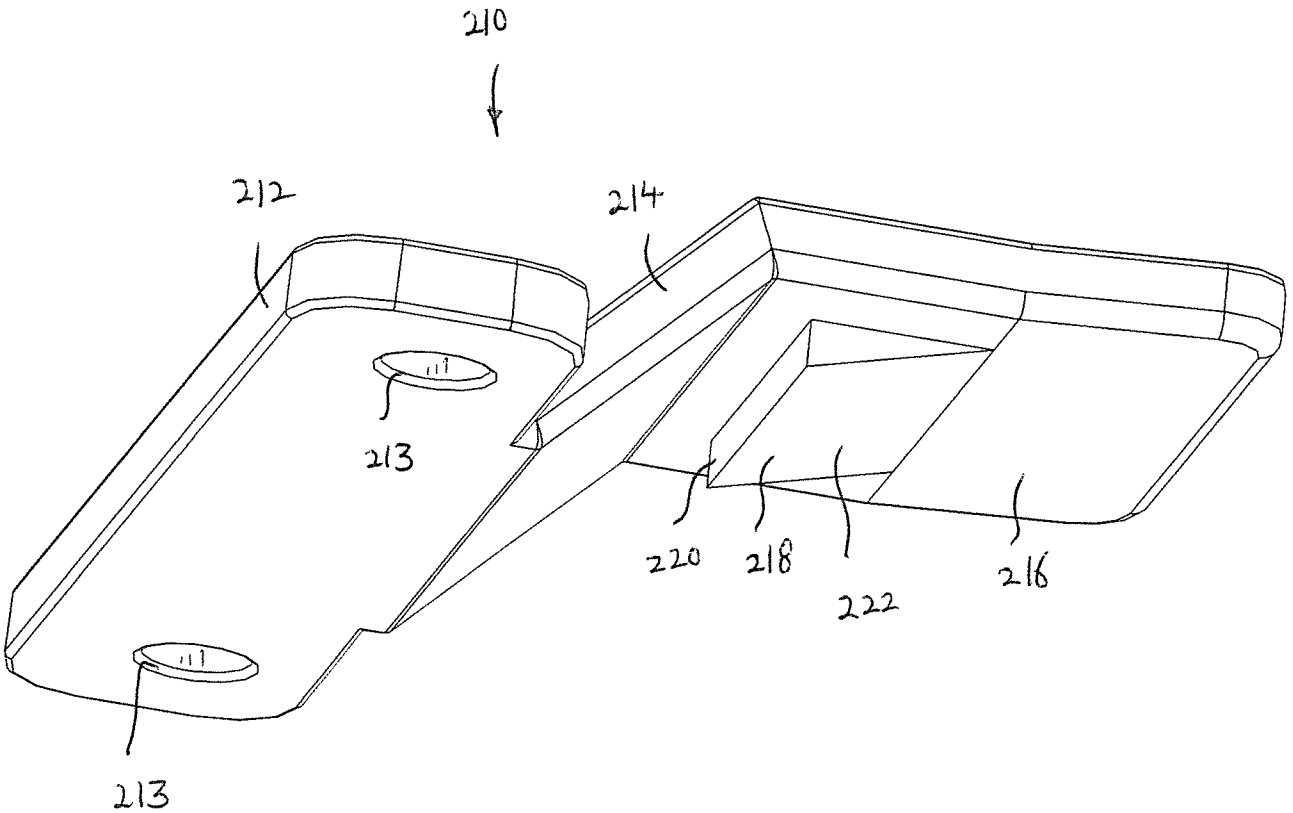
FIG. 27 is a bottom perspective view of the locking bar of the pullout support assembly.
Figure 28:
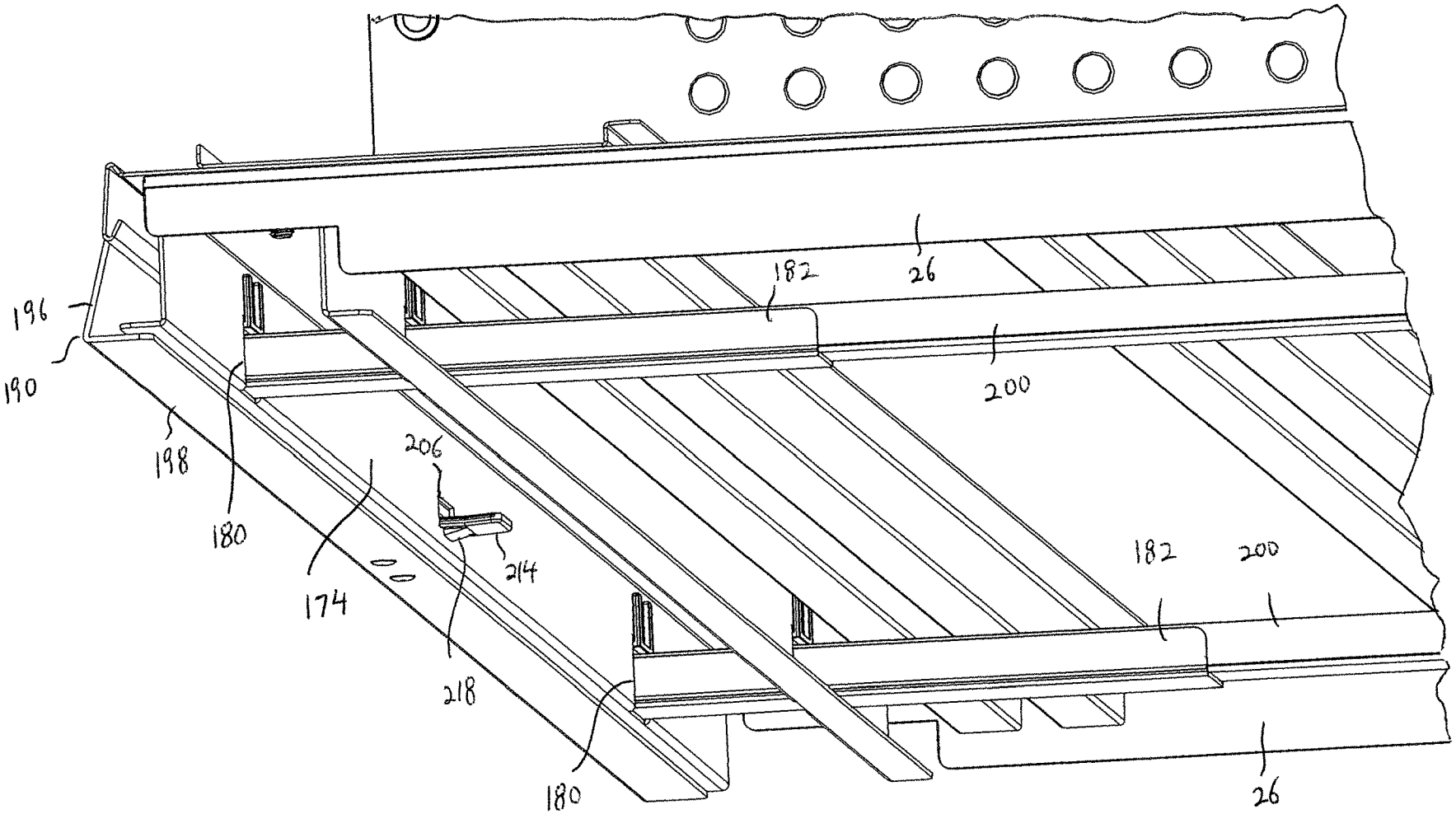
FIG. 28 is an enlarged bottom perspective view of a front portion of the pullout support assembly for merchandise display and dispensing modules in accordance with the present invention, shown in connection with the single merchandise display and dispensing module on a shelf.

As shown in FIGS. 26-28, a locking bar 210 is connected to lower transverse elongated plate 198 of elongated pullout member 192. Locking bar 210 includes a rectangular base plate 212 having two openings 213 through which fastening devices (not shown) such as rivets, screws or the like, extend for securing base plate 212 to the upper surface of lower transverse elongated plate 198 of elongated pullout member 192. A connecting wall 214 extends upwardly and rearwardly from the rear surface of the base plate 212, and a locking wall 216 extends rearwardly from the free, rear surface of connecting wall 214 in parallel relation to base plate 212. The undersurface of locking wall 216 includes a downwardly extending, triangular locking projection 218, having a forward facing, vertically oriented locking surface 220 and a lower inclined ramp surface 222.

When pullout support assembly 10 is fully pushed into its closed position, locking wall 216 extends through rectangular opening 206 of front side wall 174. During the travel through this opening 206, lower inclined ramp surface 222 of triangular locking projection 218 rides up on the lower wall defining the opening 206, thereby biasing connecting wall 214 and locking wall 216 upwardly. Once vertically oriented locking surface 220 passes through opening 206, the resilient nature of connecting wall 214 and locking wall 216 forces vertically oriented locking surface 222 downwardly to a position behind front side wall 174 into locking engagement, thereby preventing pullout support assembly 10 from being pulled out.

In order to pull out pullout support assembly 10, it is only necessary to reach under shelf 14 and push locking wall 216 upwardly, while pulling pullout support assembly 10 outwardly.

It will therefore be appreciated that the present invention provides a distinct advantage to restocking merchandise display and dispensing modules 12, which can be performed by pullout support assembly 10 at the site of the shelf 14 on which the merchandise display and dispensing modules 12 are positioned, without completely removing merchandise display and dispensing modules 12 from shelf 14. In addition, pullout support assembly 10 provides a locking arrangement to prevent a consumer from removing a pullout support assembly 12.

Having described a specific preferred embodiment of the invention with reference to the accompanying drawings, it will be appreciated that the present invention is not limited to that precise embodiments and that various changes and modifications can be effected therein by one of ordinary skill in the art without departing from the scope or spirit of the invention as defined by the appended claims.

What is claimed is:

1. A pullout support assembly for merchandise display and dispensing modules positioned on a shelf, the pullout support assembly comprising:

a guide adapted to attach to an underside of the shelf, the guide having at least one guide opening;

at least one elongated guide member slidably positioned in said at least one guide opening of said guide between a first position substantially entirely beneath the shelf and a second position pulled out with respect to the shelf, in which the at least one elongated guide member is adapted to support at least one merchandise display and dispensing module thereon; and a support connected to a front end of the at least one elongated guide member for moving the at least one elongated guide member between the first and second positions;

wherein said guide includes two walls extending down from the underside of the shelf, the at least one guide opening including aligned openings in said two walls for slidably receiving the at least one elongated guide member therein.

2. A pullout support assembly according to claim 1, wherein the at least one elongated guide member includes two parallel, spaced apart guide members, and the two walls have two sets of said aligned openings for slidably receiving the two parallel, spaced apart guide members therein.

3. A pullout support assembly according to claim 1, wherein the at least one elongated guide member includes a limiting arrangement to limit the extent that the at least one elongated guide member is adapted to be pulled out with respect to the shelf.

4. A pullout support assembly for merchandise display and dispensing modules positioned on a shelf, the pullout support assembly comprising:

a guide adapted to attach to an underside of the shelf, the guide having at least one guide opening;

at least one elongated guide member slidably positioned in said at least one guide opening of said guide between a first position substantially entirely beneath the shelf and a second position pulled out with respect to the shelf, in which the at least one elongated guide member is adapted to support at least one merchandise display and dispensing module thereon;

a support connected to a front end of the at least one elongated guide member for moving the at least one elongated guide member between the first and second positions; and at least one fixed guide member fixedly secured to said guide within said at least one guide opening, and the at least one elongated guide member is telescopically slidable within said at least one fixed guide member.

5. A pullout support assembly for merchandise display and dispensing modules positioned on a shelf, the pullout support assembly comprising:

a guide adapted to attach to an underside of the shelf, the guide having at least one guide opening;

at least one elongated guide member slidably positioned in said at least one guide opening of said guide between a first position substantially entirely beneath the shelf and a second position pulled out with respect to the shelf, in which the at least one elongated guide member is adapted to support at least one merchandise display and dispensing module thereon;

a support connected to a front end of the at least one elongated guide member for moving the at least one elongated guide member between the first and second positions; and a resilient locking bar secured to said support, and extending through a further opening in said guide in said first position to releasably lock said at least one elongated guide member and said support in said first position.

6. A pullout support assembly according to claim 5, wherein said locking bar includes a locking projection for lockingly engaging with said guide in said first position to prevent pulling out of said at least one elongated guide member with respect to said shelf.

7. A pullout support assembly according to claim 6, wherein said locking bar includes a resilient member with said locking projection positioned on said resilient member, such that said resilient member is adapted to be biased to a position that releases said locking projection from said locking engagement with said guide in said first position to permit pulling out of said at least one elongated guide member with respect to said shelf.

8. A pullout support assembly according to claim 6, wherein said locking projection has a triangular cross-sectional configuration.

9. A pullout support assembly for merchandise display and dispensing modules positioned on a shelf, each merchandise display and dispensing module including a combination finger grip and stop at a front end thereof which is adapted to be grasped to raise a front end of the respective merchandise display and dispensing module to remove the merchandise display and dispensing module from the shelf, the pullout support assembly comprising:

a guide adapted to attach to an underside of the shelf, the guide having at least one guide opening;

at least one elongated guide member slidably positioned in said at least one guide opening of said guide between a first position substantially entirely beneath the shelf and a second position pulled out with respect to the shelf, in which the at least one elongated guide member is adapted to support at least one merchandise display and dispensing module thereon; and a support connected to a front end of the at least one elongated guide member for moving the at least one elongated guide member between the first and second positions;

wherein said support includes an upper wall that covers a portion of said combination finger grip and stop in the first position to prevent raising up of the front end of the respective merchandise display and dispensing module in the first position.

10. A pullout support assembly according to claim 9, wherein the combination finger grip and stop includes forwardly extending tabs and the upper wall covers the tabs in the first position to prevent raising up of the front end of the respective merchandise display and dispensing module.

11. A pullout support assembly further for merchandise display and dispensing modules positioned on a shelf, the pullout support assembly comprising:

a guide adapted to attach to an underside of the shelf, the guide having at least one guide opening;

at least one elongated guide member slidably positioned in said at least one guide opening of said guide between a first position substantially entirely beneath the shelf and a second position pulled out with respect to the shelf, in which the at least one elongated guide member is adapted to support at least one merchandise display and dispensing module thereon;

a support connected to a front end of the at least one elongated guide member for moving the at least one elongated guide member between the first and second positions; and a shelf locking plate adapted to be secured to the shelf at a position below a front portion of the merchandise display and dispensing modules, for engaging with the merchandise display and dispensing modules to restrain movement of the merchandise display and dispensing modules on the shelf.

12. A pullout support assembly according to claim 11, wherein each merchandise display and dispensing module includes a combination finger grip and stop at a front end thereof which is adapted to be grasped to raise the front end of the respective merchandise display and dispensing module to remove the merchandise display and dispensing module from the shelf, and the shelf includes a raised front edge and the shelf locking plate includes a bent forward edge spaced by a gap from said raised front edge, with said combination finger grip and stop received in said gap to restrain movement of the merchandise display and dispensing modules on the shelf.

13. A pullout support assembly according to claim 12, wherein the shelf locking plate includes a rearward extending bend and each merchandise display and dispensing module includes a lower finger for engaging with said rearward extending bend to restrain movement of the merchandise display and dispensing modules on the shelf.

14. A pullout support assembly for merchandise display and dispensing modules positioned on a shelf, the pullout support assembly comprising:

a guide adapted to attach to an underside of the shelf, the guide having at least one guide opening;

at least one elongated guide member slidably positioned in said at least one guide opening of said guide between a first position substantially entirely beneath the shelf and a second position pulled out with respect to the shelf, in which the at least one elongated guide member is adapted to support at least one merchandise display and dispensing module thereon; and a support connected to a front end of the at least one elongated guide member for moving the at least one elongated guide member between the first and second positions;

wherein said support includes a lower wall that covers a portion of said guide in the first position.

* * * * *